US009140461B2

(12) United States Patent
Bailey

(10) Patent No.: US 9,140,461 B2
(45) Date of Patent: Sep. 22, 2015

(54) RADON EXHAUST SYSTEM WITH A DIAGNOSTIC BYPASS FILTER APPARATUS

(75) Inventor: Wayne E. Bailey, Fredericksburg, VA (US)

(73) Assignee: Wayne E. Bailey, Fredericksburg, VA (US)

( * ) Notice: Subject to any disclaimer, the term of this patent is extended or adjusted under 35 U.S.C. 154(b) by 814 days.

(21) Appl. No.: 13/506,583

(22) Filed: May 1, 2012

(65) Prior Publication Data

US 2013/0295837 A1 Nov. 7, 2013

(51) Int. Cl.

| | |
|---|---|
| ***F24F 13/20*** | (2006.01) |
| ***F24F 3/16*** | (2006.01) |
| *F24F 7/00* | (2006.01) |

(52) U.S. Cl.

CPC ..... *F24F 3/16* (2013.01); *F24F 2003/1696* (2013.01); *F24F 2007/001* (2013.01)

(58) Field of Classification Search

CPC ..... F24F 3/161; F24F 2003/1696
USPC ..... 454/356
See application file for complete search history.

(56) References Cited

U.S. PATENT DOCUMENTS

| | | | | |
|---|---|---|---|---|
| 1,292,832 | A * | 1/1919 | McDonald | 454/22 |
| 2,494,780 | A * | 1/1950 | Schmidt | 210/357 |
| 2,561,928 | A * | 7/1951 | Johnston | 392/372 |
| 2,730,873 | A * | 1/1956 | Hardin et al. | 62/317 |
| 3,252,402 | A * | 5/1966 | Burmeister | 99/646 R |
| 3,406,498 | A * | 10/1968 | Wisting | 96/249 |
| 3,475,885 | A * | 11/1969 | Kline | 96/147 |
| 3,570,386 | A * | 3/1971 | Baumann et al. | 454/212 |
| 4,537,117 | A * | 8/1985 | Cavestany et al. | 454/275 |
| 4,578,912 | A * | 4/1986 | Ericsson | 52/169.5 |
| 4,858,521 | A * | 8/1989 | Heh | 454/344 |
| 4,905,579 | A * | 3/1990 | Dame | 454/238 |
| 4,920,263 | A * | 4/1990 | Fimian et al. | 250/255 |
| 4,938,124 | A * | 7/1990 | Garza | 454/343 |

(Continued)

OTHER PUBLICATIONS

U.S. Appl. No. 61/397,142, filed Jun. 8, 2010, Bailey.

(Continued)

*Primary Examiner* — Gregory Huson
*Assistant Examiner* — Martha Becton
(74) *Attorney, Agent, or Firm* — Wayne E. Bailey

(57) ABSTRACT

A radon exhaust system comprising an exhaust side with a vent housing, a diagnostic bypass filter apparatus providing observation windows, a removable observation window, internal ice and object filter, internal ribbon flow indicators, internal water gutter with drain spout, an exhaust fan and a suction side coupled together to form a conduit through which gaseous fluid may be conveyed. The diagnostic bypass filter apparatus provides an enlarged elliptical air passage bulge and angular bend configuration having three observation windows, a fourth removable observation window, an internal ice and object filter, ribbon flow indicators, and an internal water gutter with drain spout for providing protection of the exhaust fan from falling ice, water and objects and visual inspection for flow in the exhaust system and access to the filter for cleaning.

7 Claims, 18 Drawing Sheets

(56) References Cited

U.S. PATENT DOCUMENTS

| | | | | | |
|---|---|---|---|---|---|
| 4,988,237 | A | | 1/1991 | Crawshaw | |
| 5,083,500 | A | * | 1/1992 | Francis et al. | 454/341 |
| 5,088,540 | A | * | 2/1992 | Harris | 454/220 |
| 5,101,712 | A | | 4/1992 | Dean | |
| 5,452,546 | A | * | 9/1995 | Goddard | 52/12 |
| 5,525,145 | A | * | 6/1996 | Hodge | 96/17 |
| 5,681,455 | A | * | 10/1997 | Takai et al. | 210/154 |
| 5,709,051 | A | * | 1/1998 | Mazziotti | 52/12 |
| 5,836,815 | A | | 11/1998 | Jennemann | |
| 5,850,183 | A | * | 12/1998 | Berry, III | 340/607 |
| 5,911,751 | A | * | 6/1999 | Kim | 62/407 |
| 6,241,603 | B1 | * | 6/2001 | Watson | 454/284 |
| 6,406,620 | B1 | * | 6/2002 | Rogers | 210/155 |
| 6,527,005 | B2 | | 3/2003 | Weaver | |
| 6,543,189 | B1 | * | 4/2003 | Wood, Jr. et al. | 52/169.14 |
| D501,533 | S | * | 2/2005 | Robinson et al. | D23/209 |
| 6,887,293 | B1 | * | 5/2005 | Abad et al. | 55/385.2 |
| 7,312,439 | B1 | * | 12/2007 | Kotrappa et al. | 250/255 |
| 7,734,381 | B2 | * | 6/2010 | Conger et al. | 700/301 |
| 7,818,928 | B2 | * | 10/2010 | Brunt et al. | 52/218 |
| 7,919,002 | B1 | * | 4/2011 | Hurtado | 210/747.2 |
| 8,528,263 | B2 | * | 9/2013 | Schmidt et al. | 52/16 |
| D701,593 | S | * | 3/2014 | Milne | D23/268 |
| 2004/0155028 | A1 | * | 8/2004 | Doyle | 219/535 |
| 2006/0057954 | A1 | * | 3/2006 | Hrebeniuk | 454/256 |
| 2007/0011808 | A1 | * | 1/2007 | Park | 4/679 |
| 2009/0255350 | A1 | * | 10/2009 | Decker | 73/863.12 |

OTHER PUBLICATIONS

U.S. Appl. No. 61/401,438, filed Aug. 13, 2010, Bailey.
U.S. Appl. No. 61/459,188, filed Dec. 9, 2010, Bailey.
U.S. Appl. No. 61/461,132, filed Jan. 14, 2011, Bailey.
U.S. Appl. No. 13/068,620, filed May 16, 2011, Bailey.
U.S. Appl. No. 61/634,595, filed Mar. 5, 2012, Bailey.
U.S. Appl. No. 61/685,586, filed Mar. 21, 2012, Bailey.
New Jersey Dept. of Environmental Protection, NJDEP responds to vapor mitigation system questions. Updated May 10, 2010.
"Draining water past radon fan motors installed outside" by Bill Brodhead of 2844 Slifer Valley Rd., Riegelsville, PA, www.wpb-radon.com.
Radon Today, by Radonaway, Winter issue 2008. Title:Condensation Bypass.
Radon Today, by Radonaway, Spring issue 2005. Title: Condensation II.
Radon Today, by Radonaway, Summer issue 2005. Title: Condensation III.
Radon Today, by Radonaway, Fall issue 2004. Title: Condensation.
Radon Today, by Radonaway, Spring issue 2003. Title: Mitigation System Winter Freeze-ups.

* cited by examiner

PRIOR ART

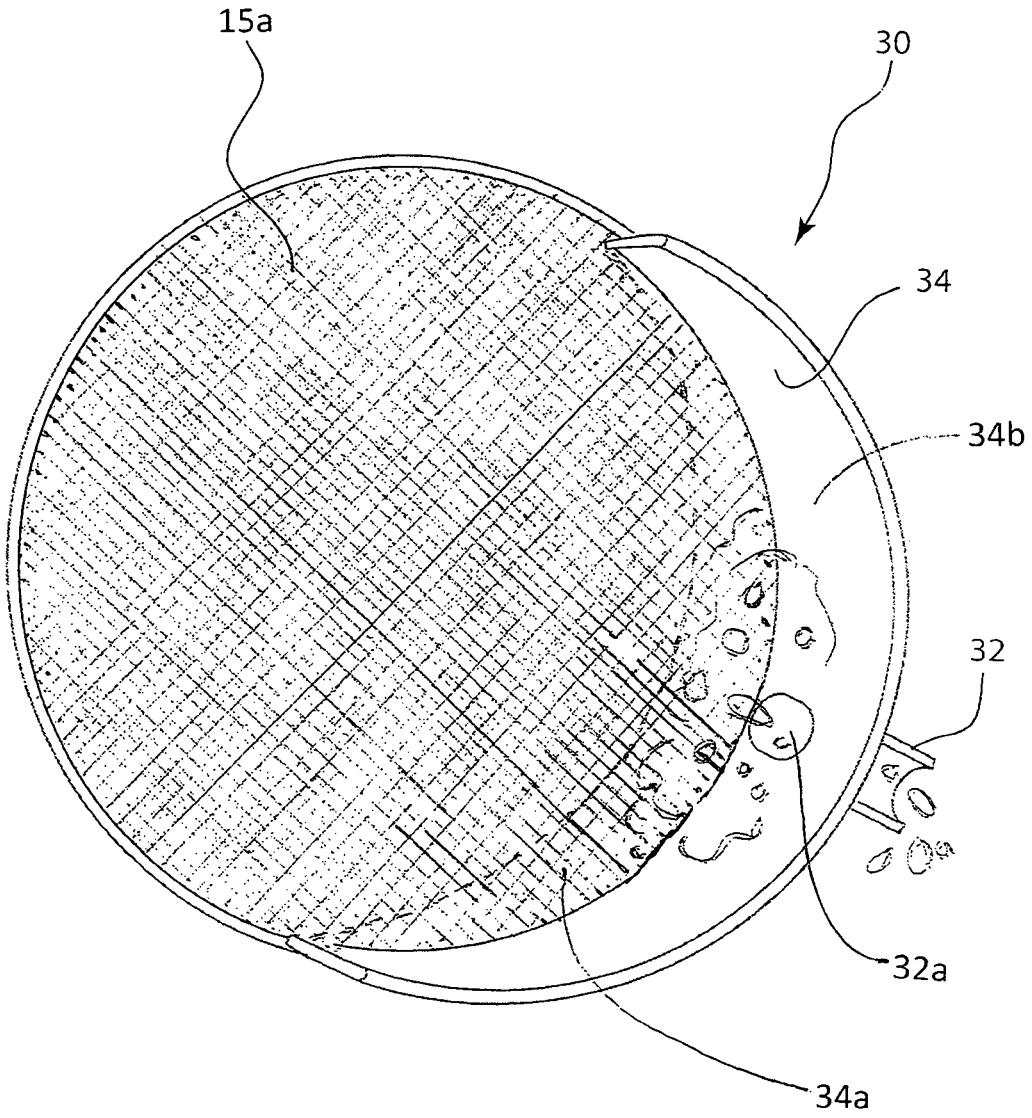
FIG. 8.1

RADON EXHAUST SYSTEM WITH A DIAGNOSTIC BYPASS FILTER APPARATUS

BACKGROUND

1. Field

Radon is a cancer causing radioactive gas fluid that has been found in homes all over the United States. Radon typically moves up through the ground to the air above and into a building through cracks and other holes in the floor. You cannot see, smell or taste radon.

Sub-slab depressurization is the most common radon mitigation technique which requires several installation steps.

The radon mitigation system is a continuous piping system beginning under a house concrete basement slab, and terminating outside and above the house.

An inline radon fan is installed in the piping system to draw the radon laced air from under the basement concrete slab to the outside and above the house.

The radon-laced air is pulled from under the basement concrete floor slab by the radon fan and pushed up the exhaust pipe and dispersed harmlessly into the atmosphere.

The radon-laced air is at earth temperature of about 50 degrees Fahrenheit with a high percent of moisture content. This produces air with high humidity content being vented through the radon mitigation system. Radon mitigation protocol requires that radon mitigation systems be operational continuously. The radon mitigation system continues to operate during warm periods of the year and winter freezing periods of the year. During warmer periods, the humid air will turn to condensate and fall back into the radon fan in the form of water which causes damage to the radon fan.

Freezing temperatures in the atmosphere during the winter causes condensate to turn to ice in the radon mitigation system exhaust pipe. As more moist air is blown into the exhaust pipe, ice continues to build and restrict air movement in the upper portion of the exhaust pipe. as the exhaust pipe becomes blocked with ice, the radon mitigation system becomes inoperative. During the warmer periods the ice breaks apart from the exhaust pipe and falls into the radon fan, causing fan damage. It is common for winter nights to freeze and winter days to thaw, resulting in many freeze-thaw cycles during a winter season.

Adding to the ice build-up problem is the birds and animals and debris screen-cap, which often installed at the top end of the exhaust pipe where the humid air is exposed to the freezing temperature of the atmosphere. The screen-cap, installed at the top of the exhaust pipe is directly exposed to freezing temperatures, thus the screen compounds the ice build-up problem as it catches moisture from the air passing through the screen and increases ice build-up. The ice will partially melt, and pieces will break off and drop down into the radon fan, causing damage. The damage to the radon fan from falling ice is a health and economic problem because when the radon fan is not operating, radon is not being removed from the house.

Therefore, for the health and welfare of building occupants it would desirable to provide a means to correct these issues.

2. Prior Art

Currently a radon fan can be somewhat protected from returning water with a condensate bypass apparatus U.S. Pat. No. 6,527,005 issued to Weaver, Mar. 4, 2003. However U.S. Pat. No. 6,527,005 does not provide a means to eliminate the birds and animals screen at the exit point of the exhaust pipe which contributes to undesirable ice build-up. U.S. Pat. No. 6,527,005 does not provide a means to stop ice, birds and animals, debris or rain water from falling into the radon fan.

U.S. Pat. No. 6,527,005 does not provide a means for an access port to allow cleaning, inspections or maintenance or a closure device, such as a closure plug, for its access port. U.S. Pat. No. 6,527,005 does not provide a means for an angled shaped housing. U.S. Pat. No. 6,527,005 claim 1, limits the condensate trap to a conically shaped sloping outer surface configuration.

U.S. Pat. No. 6,527,005 states in claim 4 that an exhaust fan apparatus comprising a housing having an exhaust port.

U.S. Pat. No. 6,527,005 states in claim 4 that the exhaust conduit is coupled to said exhaust port.

U.S. Pat. No. 6,527,005 states in claim 4 that a condensate trap located within said exhaust conduit. U.S. Pat. No. 6,527,005 claim number 5 states that the condensate trap is integral with said housing of said exhaust fan apparatus.

Utility patent application Ser. No. 13/068,620 by Bailey (self) May 16, 2011

Application No. 1306820, does not address the issue of the screen, gutter and trough creating air resistance that reduces the amount of air passing through the separator housing.

Application No. 1306820, does not include observation windows within the cap.

Application No. 1306820 does not include observation windows on the sides of the separator housing.

Application No. 1306820 does not include non-mechanical air flow indicators within the separator housing.

Application No. 1306820 does not include mechanical air flow indicators within the separator housing.

Application No. 1306820 does not include an enlarger air passage bulge area within the separator housing to address air resistance.

Application No. 1306820 does not prevent rain water from entering the radon mitigation system.

Application No. 1306820 does not address the issue of moist air originating from the damp sub-soil freezing on the metal surface of the birds and animals screen.

Application No. 1306820 does not include a screen support and gutter floor combined as one and additionally combined as one with the separator housing wall, making the gutter floor, screen support and separator housing to be one unit.

Traditionally steel mesh screen has been installed at the end of the exhaust pipe to keep birds and animals from entering the exhaust pipe. Several problems arise when using a metal screen mesh.

The first problem is that the screen will cause air passage restrictions because of the blockage of air, which can reduce the efficiency of an active mitigation system's fan.

The second problem is the location of the steel screen at the top of the exhaust pipe, where the freezing winter temperatures has a direct freezing effect on the metal wire of the screen causing it to be frozen.

The radon laced air being drawn from under the building concrete slab is often 100% humidity, this means that on some days as much as one gallon of water passes through the mitigation exhaust pipe and through the metal screen. As the humid air comes in contact with the frozen metal screen, ice begins to build up and can choke off the air passage completely. This can cause the active radon mitigation system to have unnecessary strain or shut down, causing harm to the fan and putting the building occupants at a health risk.

The same problems can exist in a passive radon mitigation system even though there is no fan in a passive radon mitigation system.

The third problem with the traditional metal screen at the top of the exhaust pipe is that rain water is allowed to enter the exhaust pipe, possibly causing damage to the radon mitigation fan. Fan manufactures recommend that water not be allow within the fan housing.

SUMMERY

The present embodiment comprises a diagnostic bypass filter housing and a vent housing that prevents debris, birds and animals, ice and rain water from entering a gaseous fluid mitigation system.

The present embodiment further compensates air flow restrictions with an additional air flow area within the diagnostic bypass filter housing, thus reducing fan stress and allowing the fan's air production to pass through the diagnostic bypass filter housing and vent housing with no added resistance.

By preventing additional air flow resistance to the radon fan, less electricity is consumed and the fan does not operate under additional load stress. Radon fans have a longer life if objects and water are not ingested and air flow is not restricted.

The present embodiment further comprises means to monitor and observe conditions within the diagnostic bypass filter housing to further extend the useful life of the radon fan.

DRAWINGS

Figures

Figure 8:
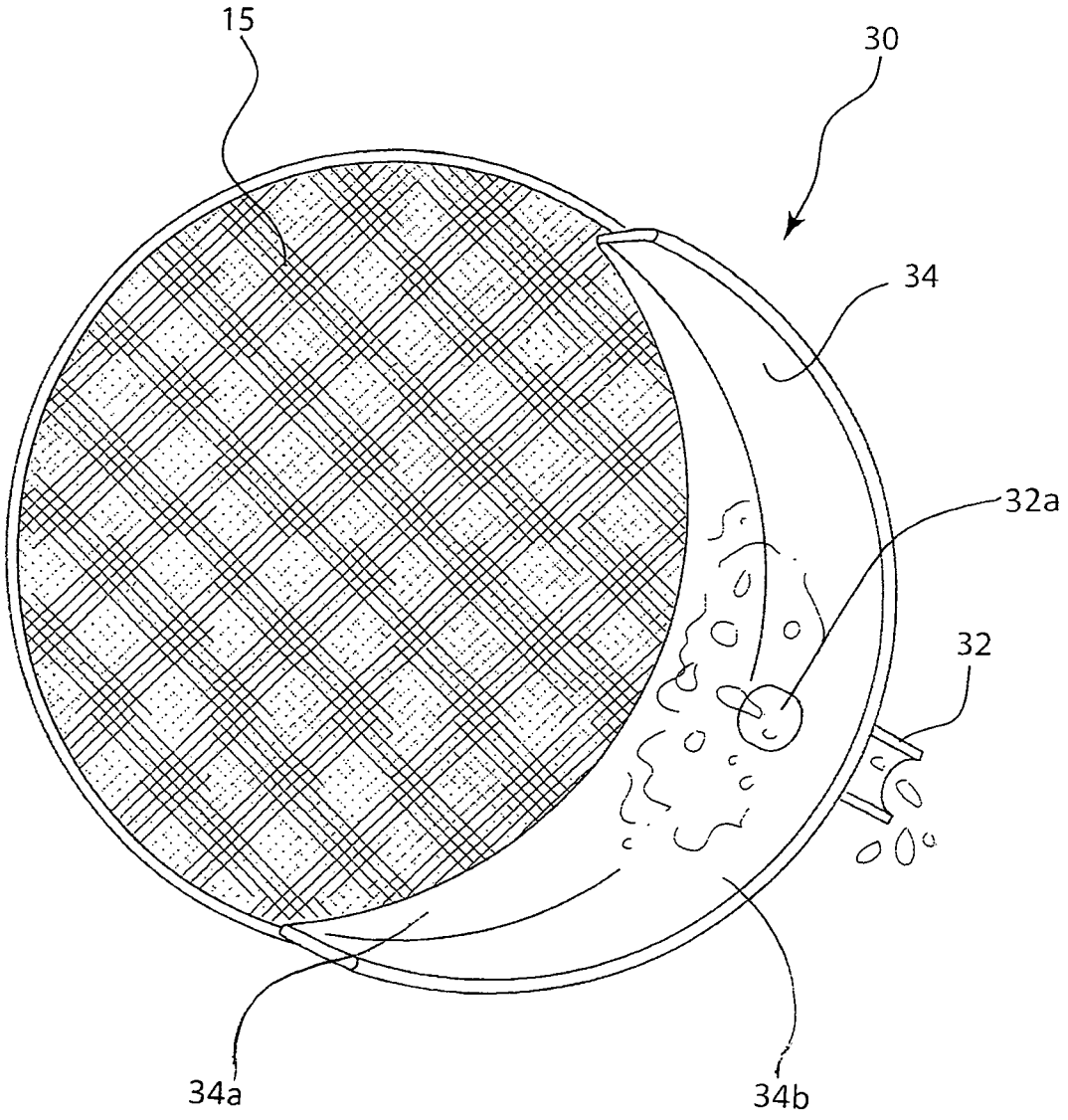
FIG. 8 shows top view of ice filter, water gutter and drain spout as one assembly.

FIG. 8.1 shows top view of ice filter, water gutter and drain spout as a second assembly.

Figure 9:
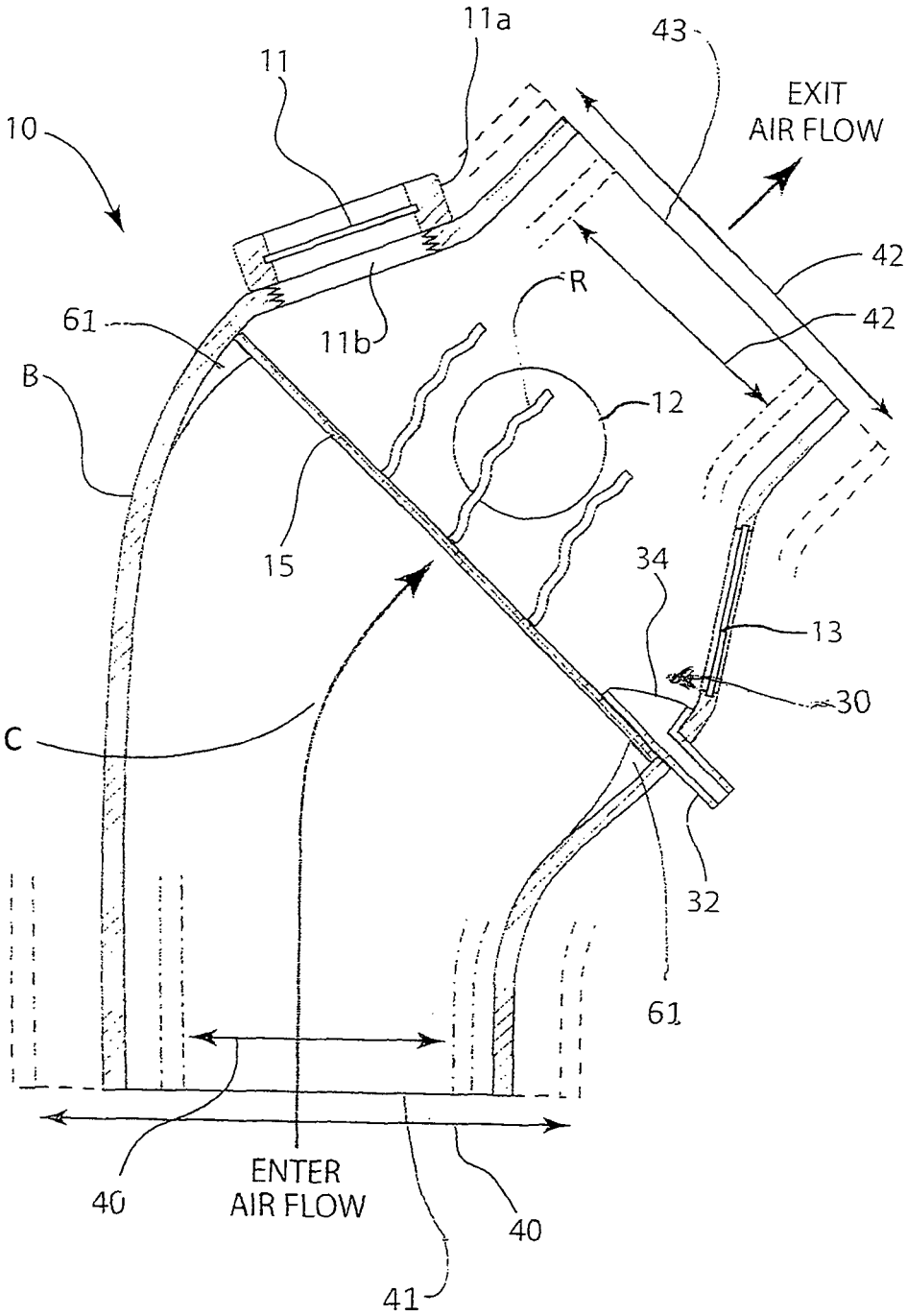

FIG. 9 shows side view of diagnostic bypass filter housing with multiple circular suction port sizes and multiple circular exhaust port sizes.

Figure 10:
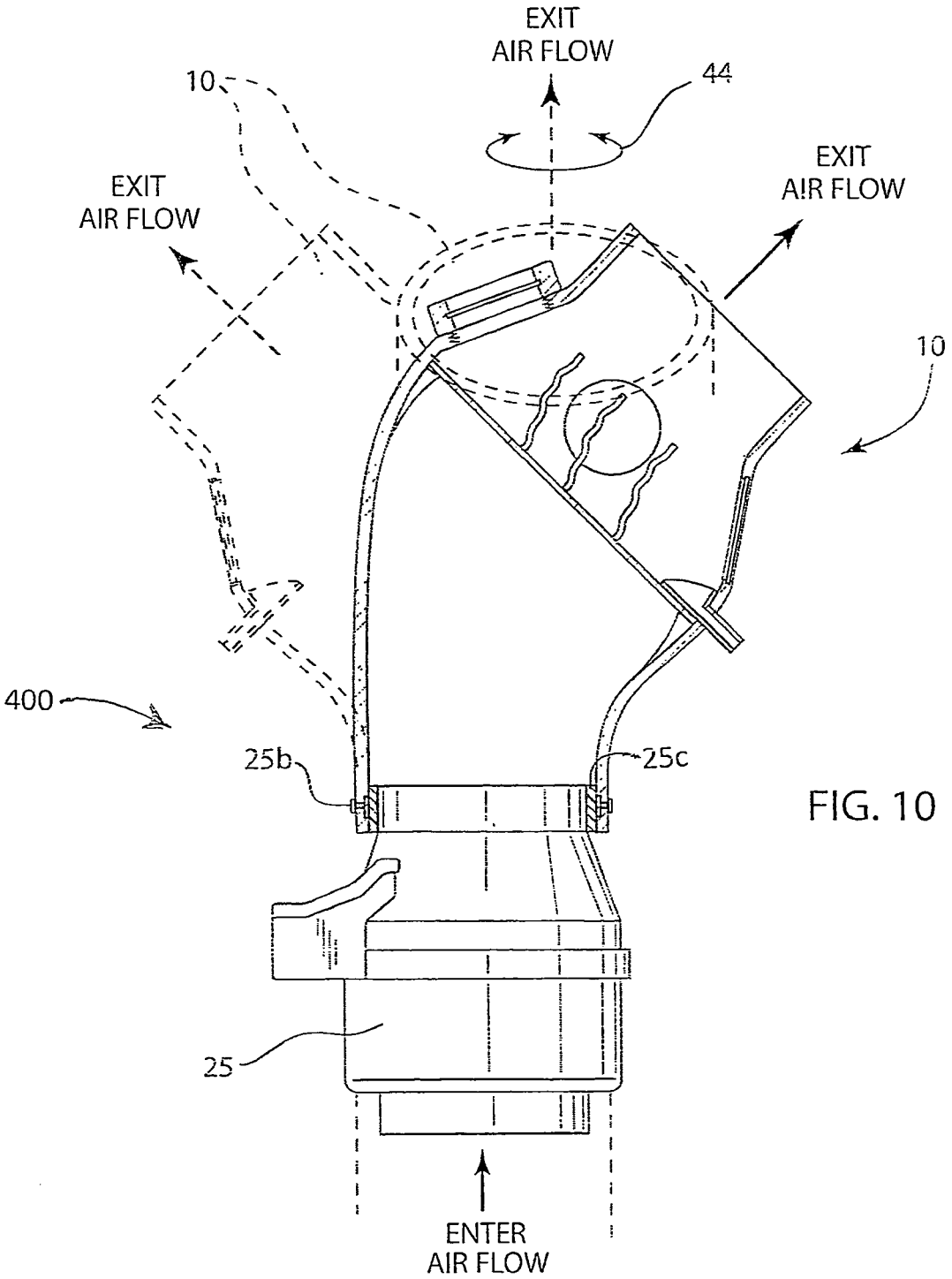

FIG. 10 shows 360 degree rotational views of the diagnostic bypass filter housing connected non-permanently and directly to the radon fan.

Figure 11:
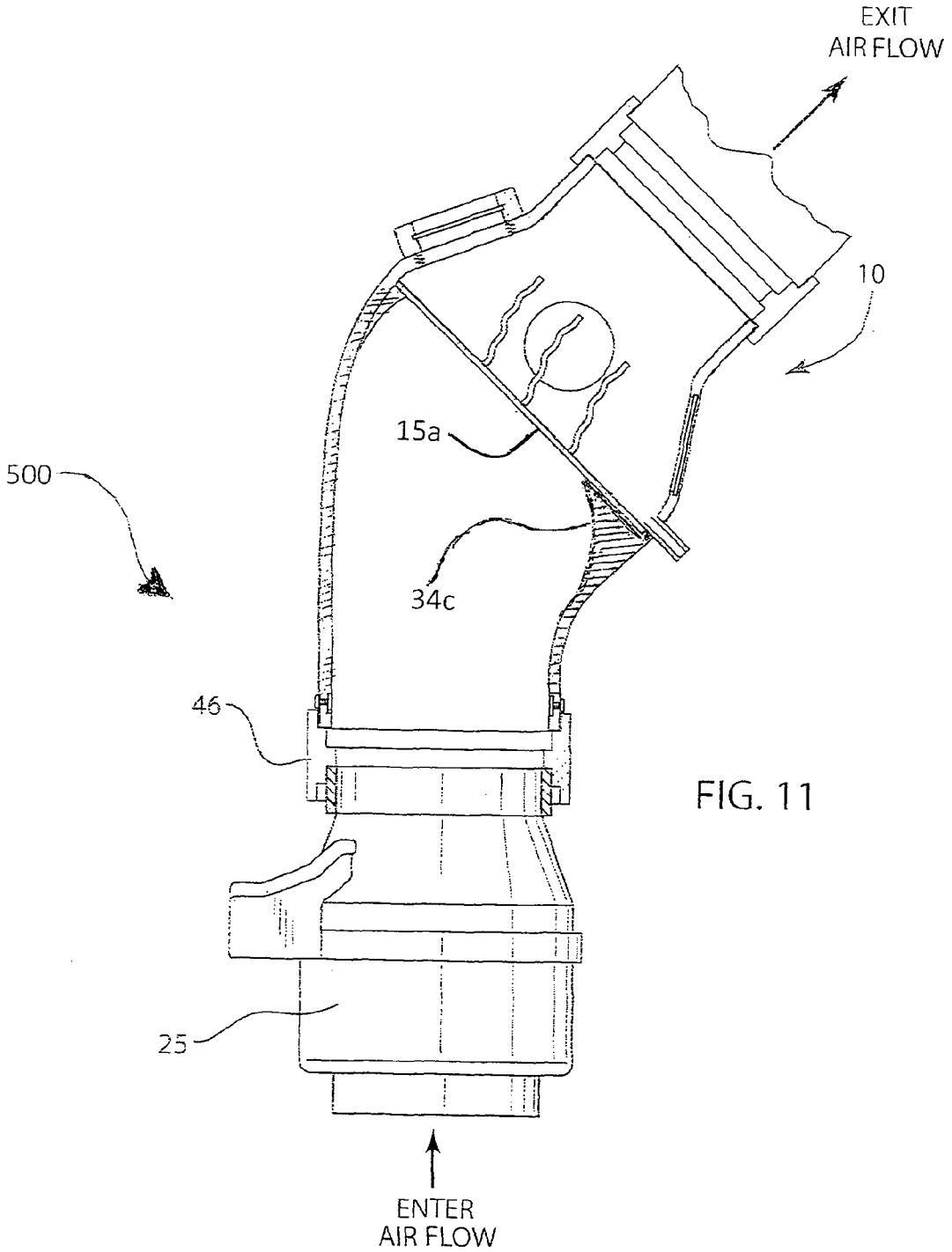

FIG. 11 shows side view of the gutter and filter support as one embodiment, with the diagnostic bypass filter housing connected permanently and directly to the radon fan.

DRAWINGS

Reference Numerals

200. Gaseous fluid mitigation system, exterior.
202. Gaseous fluid mitigation system, interior.
300. Assembly of diagnostic bypass filter housing, connector and vent housing
320. Assembly of radon exhaust fan, diagnostic bypass filter housing, connector and vent housing.
400. Assembly of diagnostic bypass filter housing, radon exhaust fan, removable fastener and coupling.
500. Assembly of diagnostic bypass filter housing, radon fan, non-removable connector.
10. Diagnostic bypass filter housing
10A. Prior Art of unimproved condensate housing.
10B. Transparent diagnostic bypass filter housing.
11. Observation window, rear.
11*a*. Closure cap of access opening
11*b*. Access opening
12. Observation windows, left and right side
13. Observation window, front
15. Circular ice filter.
15*a*. Circular ice filter, supported by gutter floor.
20. Plumbing pipe elbow, exhaust
21. Plumbing pipe, exhaust.
22. Support bracket.
23. Vent housing.
23A. Vent upper curvature opening.
23B. Vent lower curvature opening.
23C. Elongated vent exhaust opening.
23D. Vent wall.
23E. Transparent vent housing.
23F. Vent housing port, suction.
23G. Vent housing top.
24. Flexible exhaust coupling.
25. Gaseous fluid exhaust (Radon) fan.
25A. Assembly of fan, diagnostic bypass filter housing, connector and vent housing.
25*b*. Removable fastener
25*c*. Removable coupling
26. Flexible suction coupling.
27. Plumbing pipe elbow, suction.
28. Plumbing pipe, suction.
30. Assembly of filter, gutter and drain spout.
32. Drain spout.
32*a*. Drain spout opening.
34. Water gutter.
34*a*. Water gutter floor.
34*b*. Water gutter wall.
34*c*. Gutter, filter support.
40. Multiple circumferences of suction port.
41. Circular suction port.
42. Multiple circumferences of exhaust port.
43. Circular exhaust port.
44. 360 degree rotation of diagnostic bypass filter housing.
46. Permanent connector.
50. Connector.
60. Prior art of condensate air passage area.
61. Support for ice filter

62. Prior art of screen.
63. Prior art of screen support.
64. Prior art of gutter.
65. Prior art of Air turbulence and air redirection.
68. Prior art of water drain.
70. Prior art of metal birds and animals screen.
"B" Bulge, enlarged elliptical air passage bulge area
"C" Air flow corridor.
"F" Concrete floor slab.
"M" Mechanical air flow indicator.
"R" Non-mechanical air flow indicator, ribbon.
"S" Sub-soil.

DETAILED DESCRIPTION

Figure 1:
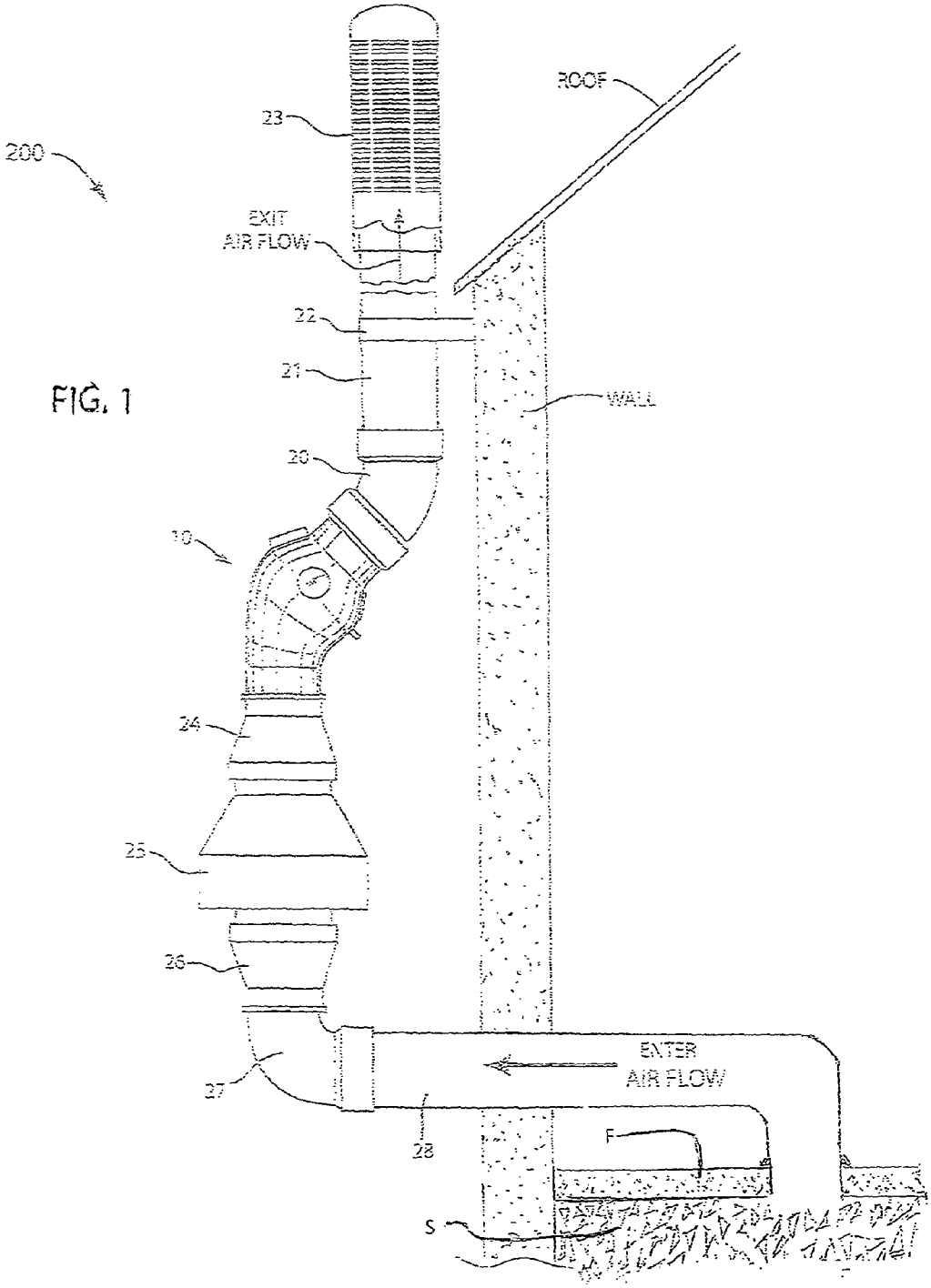
FIG. 1 shows side view of an improved gaseous fluid mitigation (radon) system as an exterior installation.

The present embodiment comprising a gaseous fluid mitigation system protective apparatus to prevent destructive objects from entering a gaseous fluid mitigation (radon) system, without producing a loss of air flow volume. The present embodiment additionally, monitors gaseous fluid mitigation system performance without producing a loss of air flow volume FIG. 1 shows the side view of an exterior gaseous fluid mitigation system 200, with a continuous air movement piping system from the sub-soil "S" below the building concrete floor slab "F" to above a roof edge of the building. The radon exhaust fan 25 draws radon laced air from under the building concrete floor slab "F" and sends the radon laced air through the exterior gaseous fluid mitigation system 200 to be expelled through the tubular vent housing 23 into the atmosphere.

All components below the gaseous fluid mitigation exhaust (radon) fan 25, including hollow suction plumbing pipe 28, hollow suction plumbing elbow 27, hollow suction flexible coupling 26, comprise the suction side of a radon mitigation system.

All components above the radon fan 25, including a hollow exhaust flexible coupling adapter 24, diagnostic bypass filter housing 10, hollow exhaust plumbing elbow 20, hollow exhaust plumbing pipe 21, vent housing 23. The hollow exhaust plumbing pipe 21, being supported by a plumbing pipe support bracket 22, comprises the exhaust side of a radon mitigation system.

The mitigation system 200 on the suction side is a hollow suction plumbing pipe 28, which extends from below a floor slab "F", exits the building wall and is connected to a hollow suction plumbing elbow 27, which is connected to a hollow flexible coupling 26. The flexible coupling 26 is connected to the downward suction port of a radon fan 25. The radon fan 25 is connected at its upward exhaust port to a hollow flexible coupling 24, which then connects to the suction port 41 of the diagnostic bypass filter housing 10. The diagnostic bypass filter housing 10 connects, on the exhaust port 43 to elbow 20, which connects to pipe 21, which is secured to a building wall by brackets 22. The pipe 21 is connected to the lower air receiving end of the vent 23, which is located above the building roof edge. The vent 23, being open at its lower receiving end 23F, receives radon laced air driven by the radon fan 25 up through the mitigation system 200 and expels the same radon laced air through air openings 23C on the vertical surface of vent 23.

The vent 23 is described as a tubular shaped apparatus, open to receive radon laced air at the lower receiving vent port 23F and closed at the top end 23G to prevent the intrusion of rain water and destructive objects. Elongated and downward venting exhaust openings 23C occupy the circular vertical wall surface to allow maximum air flow while restricting rain water and destructive objects from entering the mitigation system 200.

I contemplate that the radon fan 25 be any one of multiple models and sizes manufactured by any one of multiple manufactures and being well known in the radon mitigation industry.

At present I contemplate that pipes 28&21, elbows and brackets, 27&20&22, to be manufactured of Plastic material, in sizes 2" to 12"diameter, but other materials and sizes are also suitable. At present I contemplate that flexible couplings 26&24 be manufactured of a rubber formula in sizes 2" to 12"diameter to join plumbing components of different sizes but other materials and sizes are suitable. The flexible couplings 26&24 having an adjustable metal band for securing an airtight seal. Hollow flexible couplings with adjustable metal bands are well known in the radon mitigation and plumbing industry.

The mitigation system 200, is a continuous airtight passageway for moving radon laced air from the building subsoil and expelling it safely above a roof of the building. Radon mitigation systems are individually custom designed at the job site and installed by professionals in the radon mitigation industry.

Figure 1A:
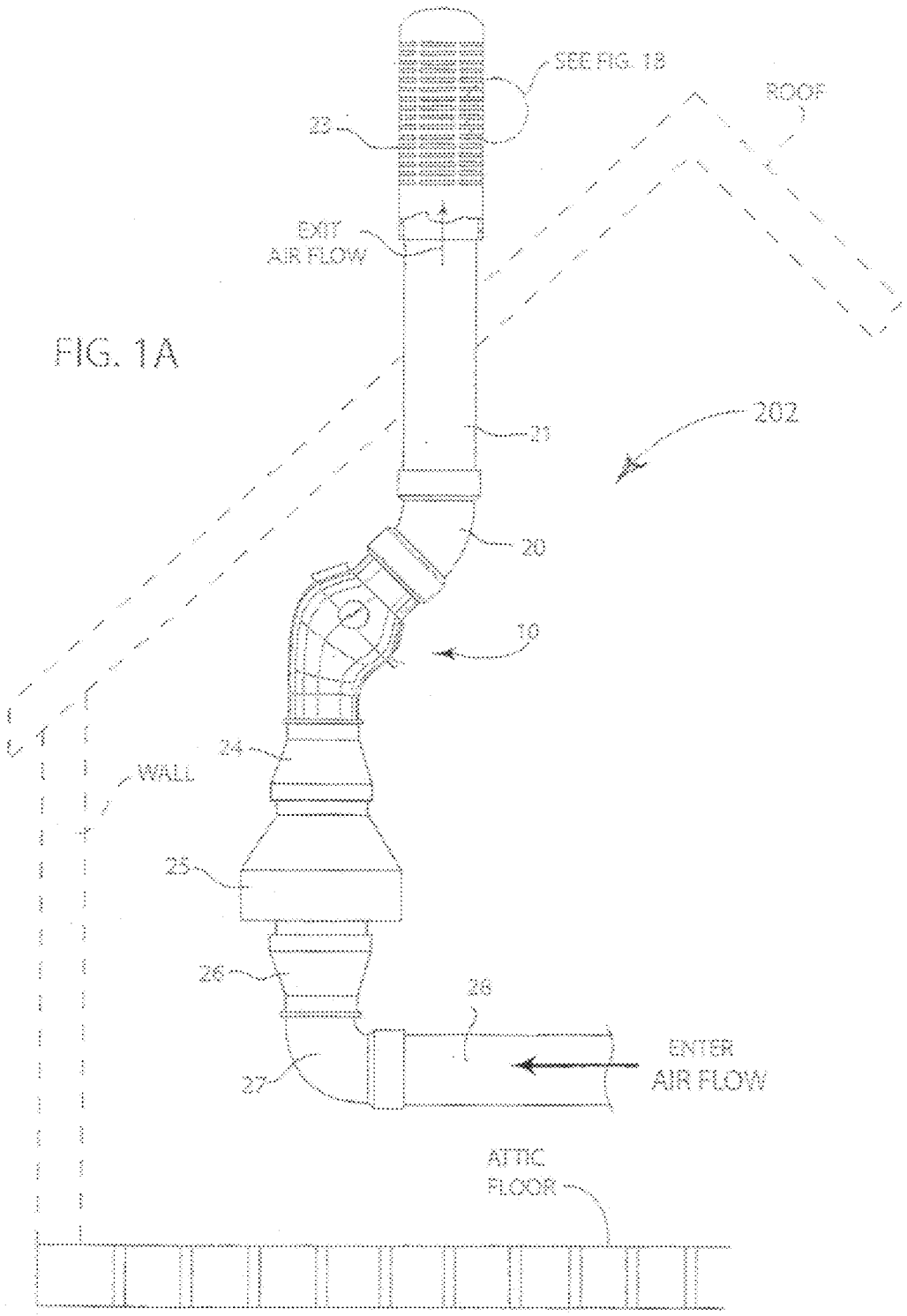
FIG. 1A shows side view of an improved gaseous fluid mitigation (radon) system as an interior installation.

FIG. 1A shows the side view of an interior gaseous fluid mitigation system 202, with a continuous passageway for moving radon laced air from the building sub-soil "S" and expelling it safely above the building roof. Radon mitigation systems are individually custom designed at the job site and installed by professionals in the radon mitigation industry.

The radon exhaust fan 25 draws radon laced air from the sub-soil "S" under the floor slab "F" and sends the radon laced air through the interior gaseous fluid mitigation system 202 to be expelled through the vent 23 into the atmosphere.

All components below the radon fan 25, including pipe 28, elbow 27 and flexible coupling 26, comprises the suction side of a radon mitigation system.

All components above the radon fan 25, including coupling 24, diagnostic bypass filter housing 10, elbow 20, pipe 21, vent 23 and pipe 21, being supported by bracket 22, comprises the exhaust side of a radon mitigation system.

Mitigation system 202 on the suction side is pipe 28, which extends from below a floor slab "F", exits the building wall and is connected to elbow 27, which is connected to coupling 26. The coupling 26 is connected to the downward suction port of a radon fan 25. The radon fan 25, is connected at its upward exhaust port to flexible coupling 24, which then connects to the suction port 41 of the diagnostic bypass filter housing 10. The diagnostic bypass filter housing 10 connects at its exhaust port 43 to elbow 20, which connects to pipe 21, which is secured to the building wall by bracket 22. The pipe 21 is connected to the lower receiving end of the vent housing 23F, which is located above the building roof. The vent 23, being open at its lower vent port 23F, receives radon laced air driven by the radon fan 25, up through the mitigation system 202 and expels the same radon laced air through elongated and downward venting exhaust openings 23C on the vertical surface of the vent 23. The vent 23 is a tubular shaped apparatus, which is open to receive the radon laced air at the vent port 23F which is closed at the top 23G to prevent the intrusion of rain water and destructive objects.

Exhaust openings 23C occupy the circular vent housing wall 23D to allow unrestricted radon laced air exhaust while preventing intrusion of rain water and destructive objects from entering the mitigation system 202.

At present I contemplate that pipes 28&21, elbows and brackets 27&20&22 to be manufactured of plastic material and sized from 2" to 12' diameter, but other materials and sizes are also suitable.

At present I contemplate that couplings 26&24 be manufactured of a rubber formula with multiple sizes at both ends to join plumbing components of different sizes, including joining to a radon fan 25 and joining to diagnostic bypass filter housing 10 with different port circumference sizes 40&42.

At present I contemplate the housing ports 40&42 be made of plastic and 1/16" to 5/16" thick body wall but other materials and body thicknesses are suitable. The couplings 26&24 having an adjustable metal band with means to be tightened to secure an airtight seal. Flexible couplings are well known in the radon mitigation and plumbing industry. The mitigation system 202, being a continuous airtight passageway for moving radon laced air from the sub-soil "S" and expelling it safely above a building roof.

Radon mitigation systems are individually custom designed at a job site and installed by professionals in the radon mitigation industry.

Figure 1B:
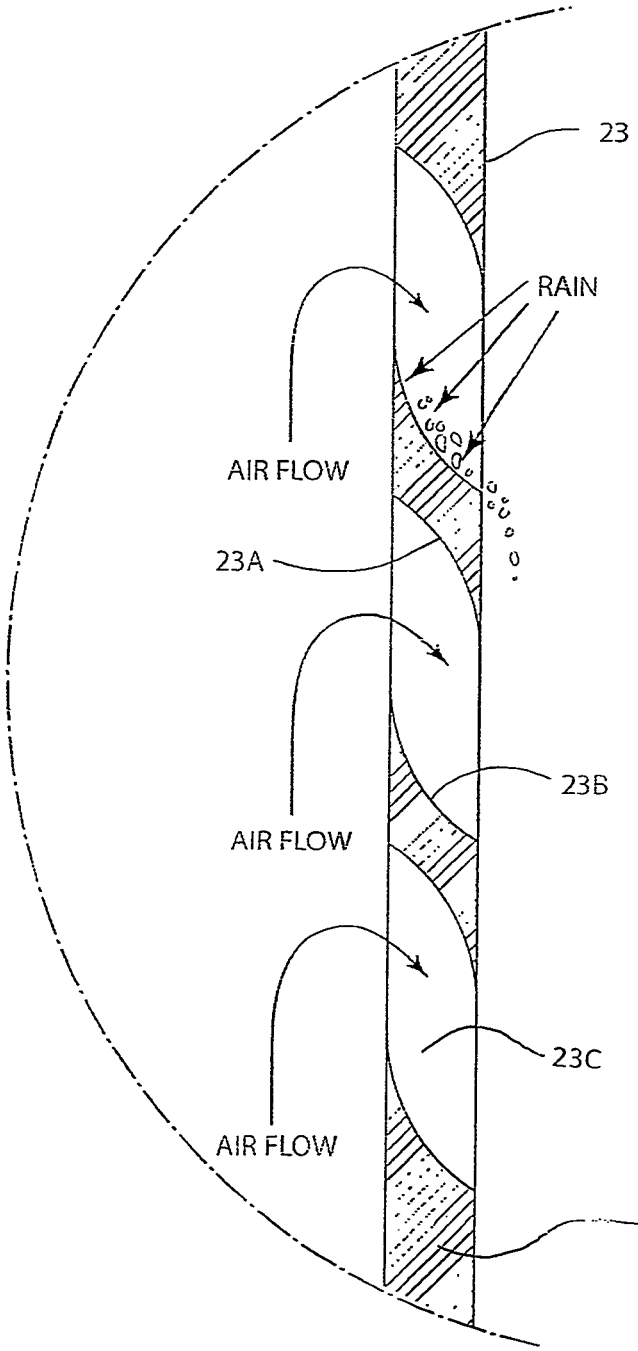
FIG. 1B shows cross sectional side view of the vent housing wall with exhaust openings.

FIG. 1B shows a detail cross sectional view of the vent wall 23D of the vent 23, with upper curvature surface 23A of the exhaust openings 23C and lower curvature surface 23B of the exhaust openings 23C to allow air flow and prevent intrusion into the vent 23 from rain or destructive objects. Exhaust openings 23C are open on the inside of vent housing wall 23D at a higher elevation and proceed downward to open on the outside of vent housing wall 23D at a lower elevation to restrict gravity controlled rain water from entering the vent 23. The exhaust openings 23C of the vent 23 allows air flow passage while disallowing intrusion of rain water or destructive objects. The multiple openings are sized and shaped to allow maximum air flow and prevent the intrusion of rain water and destructive objects. The air flow capacity of the exhaust openings 23C exceeds the capacity of air passing through the mitigation systems 200&202.

The larger air flow capacity of the exhaust openings 23C of the vent 23 exceeds the air volume delivered by the radon mitigation fan 25. The vent 23 is not a restrictor of air volume delivered by the mitigation system 200. At present I contemplate that the vent 23 be manufactured of plastic with 1/16" to 5/16" thick wall and 2" to 12" tubular circumference, but other materials, sizes and thicknesses are suitable.

Figure 1C:
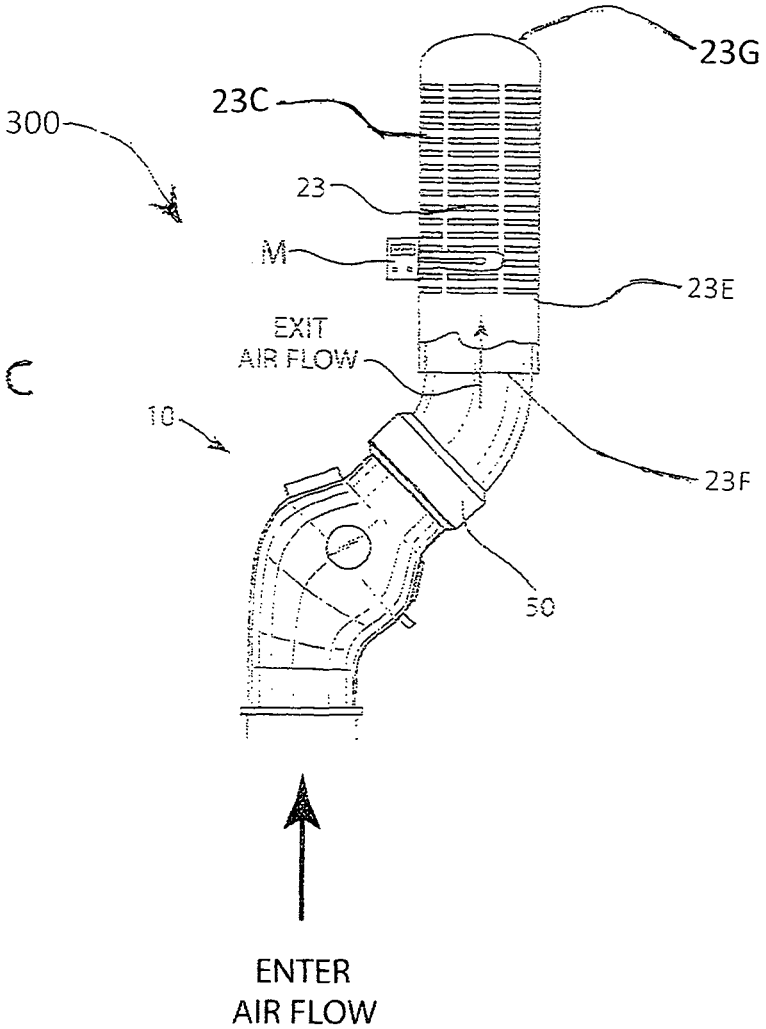
FIG. 1C shows side view of the diagnostic bypass filter housing connected directly to the vent housing as one unit.

FIG. 1C shows another embodiment of the gaseous fluid mitigation system protection apparatus, comprising a bypass housing 10, vent 23 and hollow connector 50. The diagnostic bypass filter housing 10, vent 23 and hollow connector 50 are joined at the job site as one assembled unit 300 when required by custom job site installation conditions.

The vent 23 is a hollow, circular shaped embodiment, which receives radon laced air at the vent port 23F and expels the radon laced air through the exhaust openings 23C.

Another embodiment is the transparent vent housing 23 E which is manufactured with a transparent plastic material. Solar heat enters the transparent vent 23E and thaws ice build-up within the transparent vent 23E. The thawing of ice build-up within the transparent vent 23E clears ice blockage and improves air movement within the transparent vent 23E. The ice blockage produces air flow resistance which causes strain and damage to the radon fan 25.

Another embodiment is the transparent vent cap 23G, which is manufactured from transparent plastic. The vent cap 23G, located at the top of vent 23E prevents the intrusion of rain water and damaging objects from entering the vent 23E and transparent vent housing 23E. Additionally, the vent cap 23G allows solar heat and solar light to enter the vent 23 or the transparent vent 23E to assist in preventing ice build-up within the vents 23&23E.

Another embodiment is the mechanical air flow indicator "M", which measures air flow within the vent 23 and vent 23E. The monitoring of air flow by the mechanical air flow indicator "M" reports the operational efficiency of the mitigation system 200. Mechanical air flow indicators are well known in the industry.

Figure 1D:
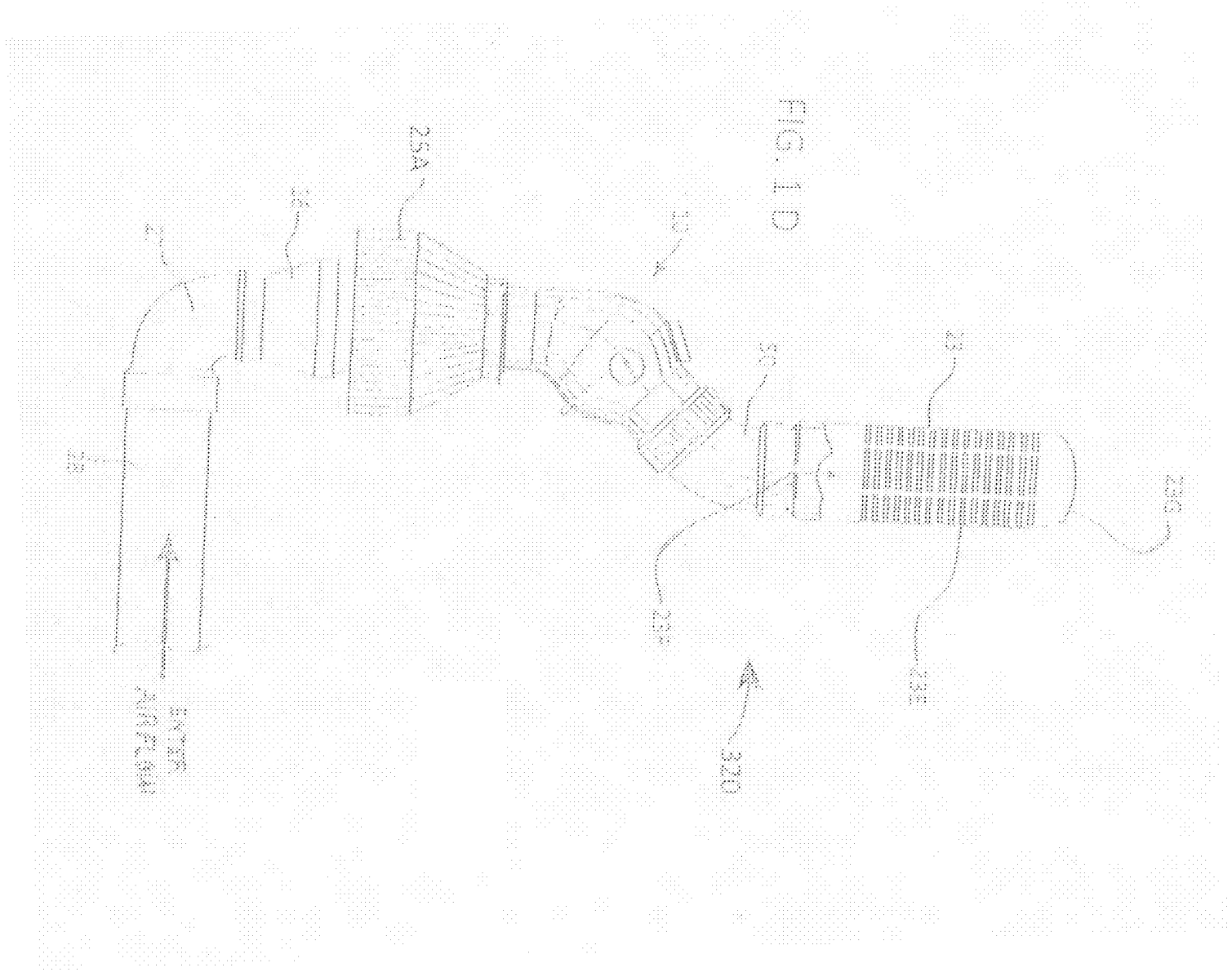
FIG. 1D show side view of the diagnostic bypass filter housing connected directly to the radon fan and to the vent housing as one unit.

FIG. 1D shows another embodiment of radon fan 25A connected directly to the diagnostic bypass filter housing 10, the diagnostic bypass filter housing 10 is connected directly to the connector 50, the connector 50 is connected directly to the vent 23 and are joined at the job site as one assembled unit 320.

The side view of the gaseous fluid mitigation system, comprising pipe 28, which is connected to elbow 27, which is connected to flexible coupling 26. The flexible coupling 26 is attached to the radon fan 25A. Radon laced air is blown by the radon fan 25A through the vent 23. Radon fan 25A being radon fan 25 connected directly to the diagnostic bypass filter housing 10 eliminating flexible coupling 24.

Other embodiments are the transparent vent 23E and the transparent vent cap 23G, which allows solar heat to enter and assist in reducing ice build-up within the transparent vent 23E.

Figure 2:
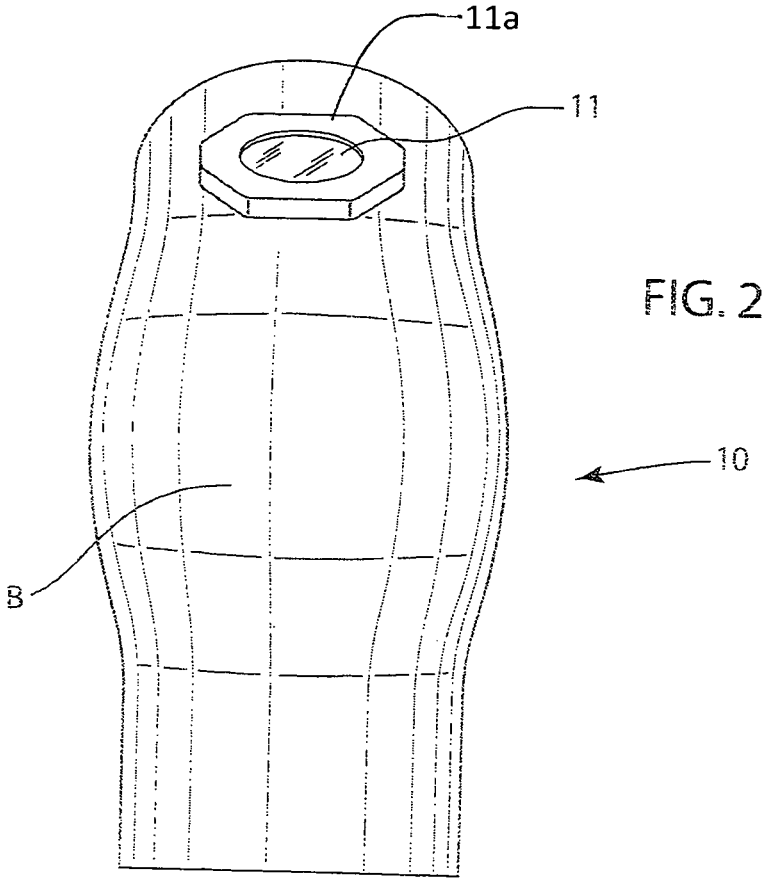
FIG. 2 shows rear view of the diagnostic bypass filter housing with closure plug, access opening and bulge area.

FIG. 2 shows a rear view of the diagnostic bypass filter housing 10, comprising of an enlarged air passage bulge area "B" to receive and accommodate additional air flow volume as the air passes through the diagnostic bypass filter housing 10.

The diagnostic bypass filter housing 10, comprising an observation window 11 within the access opening male threaded closure cap 11*a*. The observation window 11 within the closure cap 11*a* permits visual monitoring of conditions and air movement within the diagnostic bypass filter housing 10. Additionally, solar light enters the observation window 11 to assist with visual monitoring within the diagnostic bypass filter housing 10.

Figure 2A:
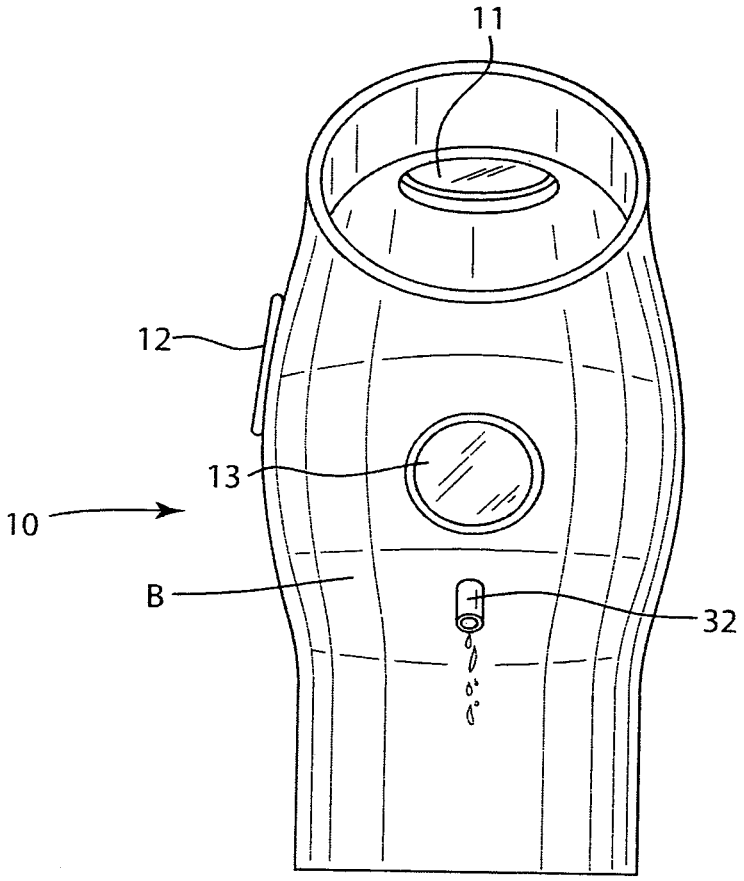
FIG. 2A shows front view of diagnostic bypass filter housing with windows, bulge area and spout.

FIG. 2A shows another embodiment of the diagnostic bypass filter housing 10. Left and right side observation windows 12 are located on both sides of the diagnostic bypass filter housing 10 to allow internal observation of the diagnostic bypass filter housing 10 from either side and to allow additional lighting to enter the diagnostic bypass filter housing 10 to assist observation quality. The rear window 11 is located within the closure cap 11*a* to allow internal observation of the diagnostic bypass filter housing 10 from the rear side and to allow additional lighting to enter the diagnostic bypass filter housing 10 to assist observation quality.

The front side observation window 13 is located on the front side of the diagnostic bypass filter housing 10 to provide an additional observation angle and allow solar light and solar heat within the diagnostic bypass filter housing 10. Window 13 additionally allows ice melting solar heat to enter the diagnostic bypass filter housing 10. Windows 11,12 and 13 allow solar heat to enter the bypass housing 10 to assist the melting process of ice suspended by the ice filter 15.

Internal observation of the diagnostic bypass filter housing 10 is required to monitor air flow indicators "R" & "M" and observe general operational conditions. The enlarged air passage bulge area "B" provides an expanded area for air passage. The water drain spout 32 exits the bypass diagnostic bypass filter housing 10 on the front side to carry water away which is collected by the water gutter 34 within the diagnostic bypass filter housing 10.

Figure 3:
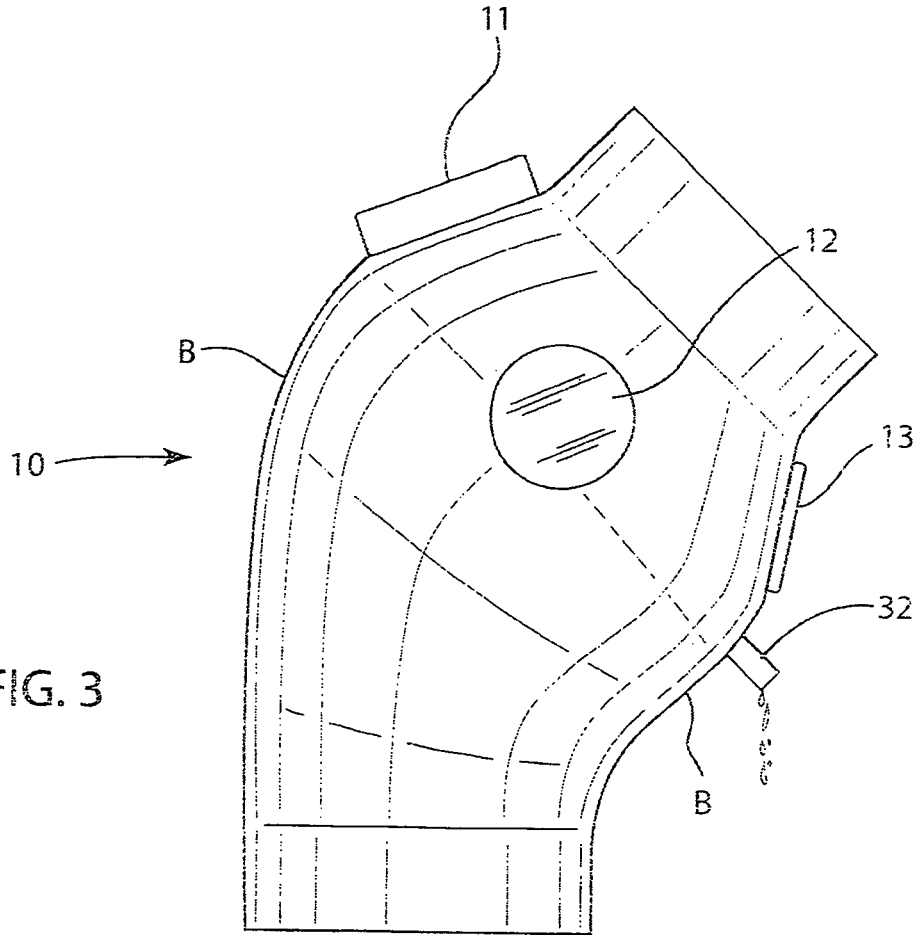
FIG. 3 shows side view of diagnostic bypass filter housing with bulge area and windows.

FIG. 3 shows a side view of the diagnostic bypass filter housing 10, comprising the bulge area "B" of the diagnostic bypass filter housing 10 which allows additional air passage through the diagnostic bypass filter housing 10. Diagnostic bypass filter housing 10 comprises a window 11 within the closure cap 11*a* on the rear side of the diagnostic bypass filter housing 10, which allows visual monitoring, solar lighting and solar heating of the diagnostic bypass filter housing 10 interior.

Another embodiment is window 13, located on the front side of the diagnostic bypass filter housing 10, to allow visual monitoring, additional solar lighting and solar heating within the diagnostic bypass filter housing 10 interior.

Another embodiment are the left and right side observation windows 12 located on both sides of the diagnostic bypass filter housing 10, to allow visual interior monitoring, solar lighting and solar heating within the diagnostic bypass filter housing 10 interior. The water drain spout 32 exits the bypass housing front side to carry water by gravity out of the diagnostic bypass filter housing 10.

Figure 4:
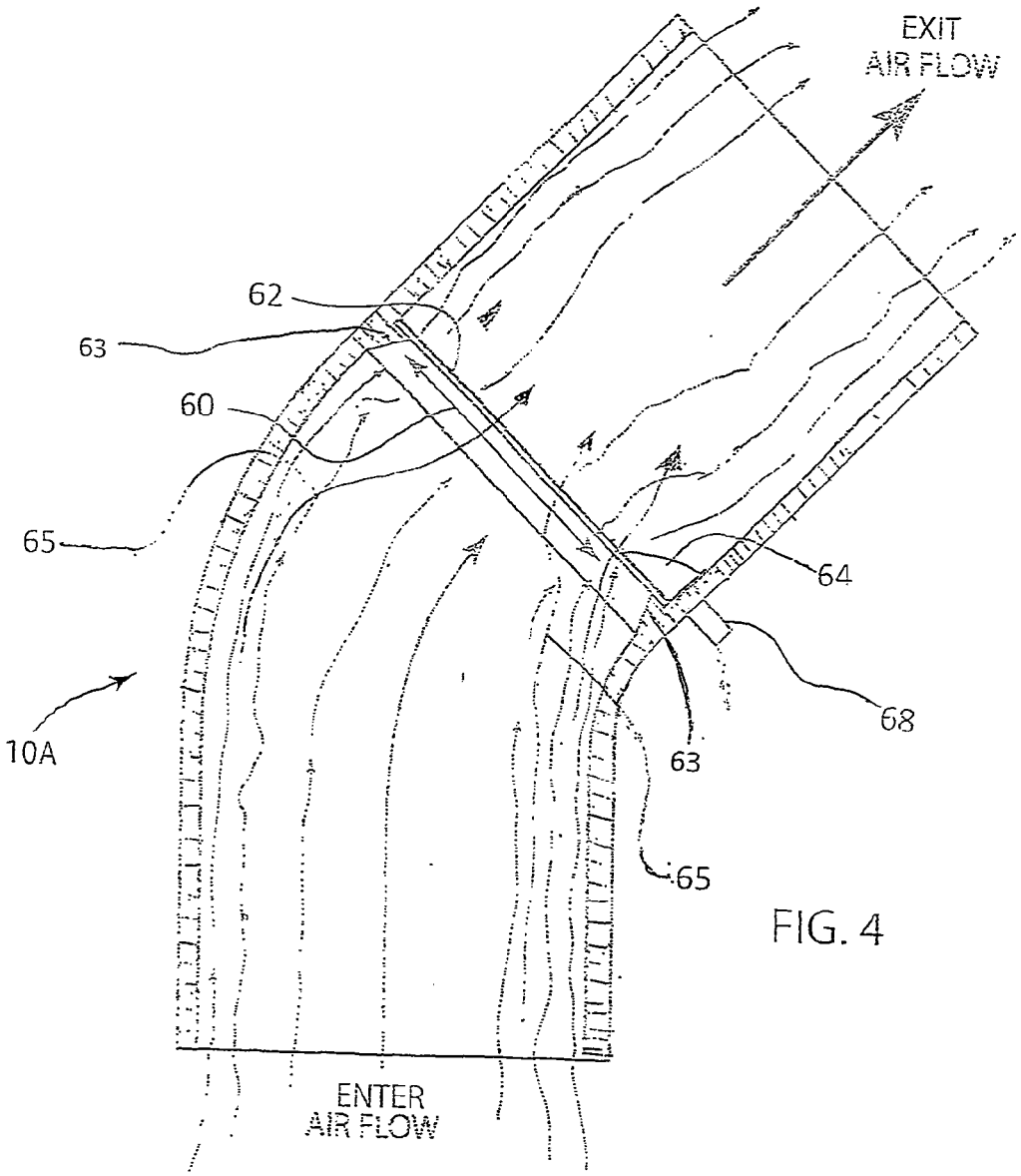
FIG. 4 shows side view of prior art with air turbulence and restricted air flow area.

FIG. 4 shows side view of prior art of an unimproved condensate bypass housing 10A, comprising a screen 62 and gutter 64 which restricts air volume passage through a housing 10 A. Additionally an air passage area 60 is decreased in capacity by screen supports 63. Air forced around screen supports 63, gutter 64 and through screen 62, causes air volume reduction and air turbulence 65. The air flow reduction and turbulence 65 decreases the efficiency of a radon fan 25 causing extra wear and damage. This prior art fails to compensate for the air flow reduction and turbulence 65 within its bypass housing 10A, resulting in an inefficient radon mitigation system and stress to a radon fan 25. There are different designs of prior art condensate bypass devices that create air flow restrictions.

Figure 4A:
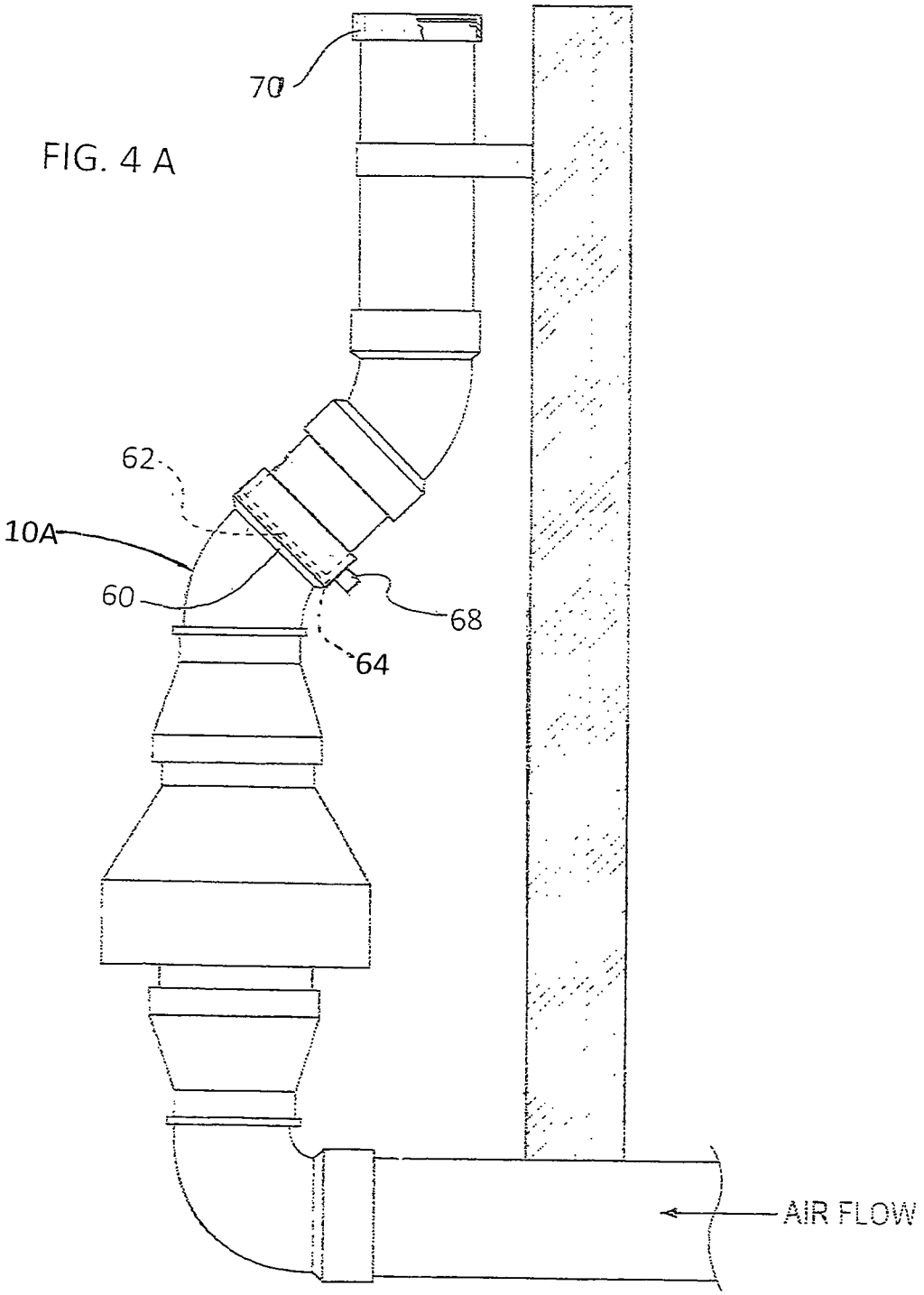
PRIOR ART FIG. 4 A
FIG. 4A shows side view of prior art of bypass housing and critter screen.

FIG. 4A shows side view of prior art of unimproved condensate bypass housing 10A and prior art of unimproved metal birds and animals screen 70, as part of an unimproved exterior radon mitigation system. The horizontal birds and animals screen reduces air passage flow by its metal wire mesh, which is an air flow restriction. Ice formation during freezing weather on the horizontal surface of the metal mesh of the birds and animals screen 70 will restrict additional air passage. Freezing rain forms additional ice blockage on the horizontal surface of a metal birds and animals screen 70. During freezing weather a metal horizontal birds and animals screen 70 can become completely air blocked, resulting in a non-performing mitigation system.

An unimproved bypass housing 10A, comprising a reduced air passage area 60 and additional air restrictions from the drain 68, gutter 64 and screen 62 further reduces the operational efficiency of a radon system. The unimproved bypass housing 10A does not benefit from the improvements offered by the present embodiments.

Figure 5:
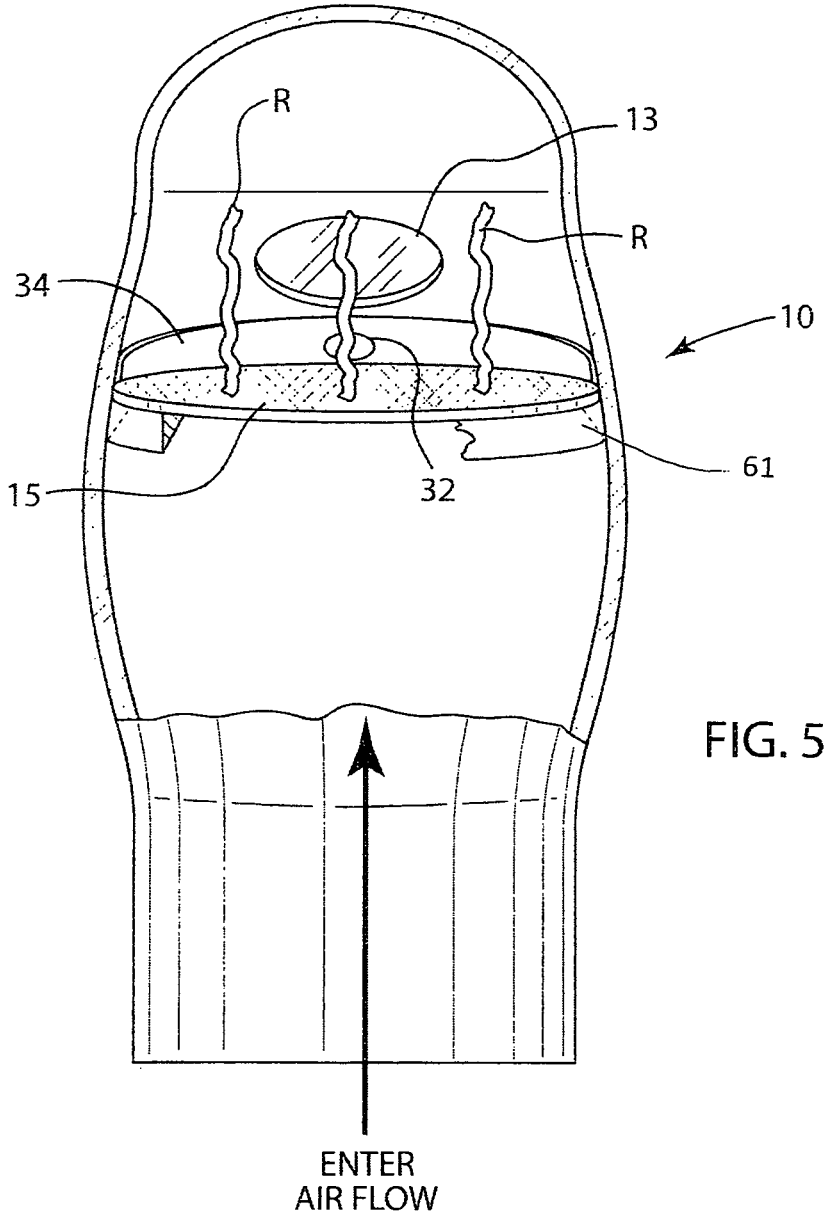
FIG. 5 shows cut away rear view of diagnostic bypass filter housing with non-mechanical air movement indicators.

FIG. 5 shows another embodiment of the rear cross sectional view of the diagnostic bypass filter housing 10 comprising window 13 in front side of diagnostic bypass filter housing 10. The water gutter 34 is positioned within the diagnostic bypass filter housing 10 to receive water which will be drained away by the water drain spout 32. Ice and debris are retained by the ice filter 15 to prevent damage to the radon fan 25. Trapped debris is removed through the access opening 11*b*.

Another embodiment is the screen support 61 within the diagnostic bypass filter housing 10 which is the base holding the circular ice filter 15. The screen support 61 is an extension of the diagnostic bypass filter housing 10 wall and is as one part of the diagnostic bypass filter housing 10 wall.

Other embodiments are the non-mechanical air flow indicators "R" attached within the diagnostic bypass filter housing 10 to measure air velocity and air volume as it passes through the air flow corridor "C" of the diagnostic bypass filter housing 10. The non-mechanical air flow indicators "R" may be made of a flexible, light-weight material attached at its bottom to filter 15, with its upper portion, lifted upwardly by air flow produced from below by a radon fan 25.

An example of an air flow indicator "R" is a lightweight material such as a fluttering ribbon extended upward by the force of passing air from below generated by a radon fan 25. The fluttering ribbons of non-mechanical air flow indicators "R" may be attached to filter 15 and its performance monitored through windows 11,12 & 13. Monitoring the non-mechanical air flow indicators "R" through windows 11,12&13, provides visual system performance evaluation without entering the bypass housing 10. At present I contemplate the ribbons be made of nylon but other materials are suitable.

Figure 6:
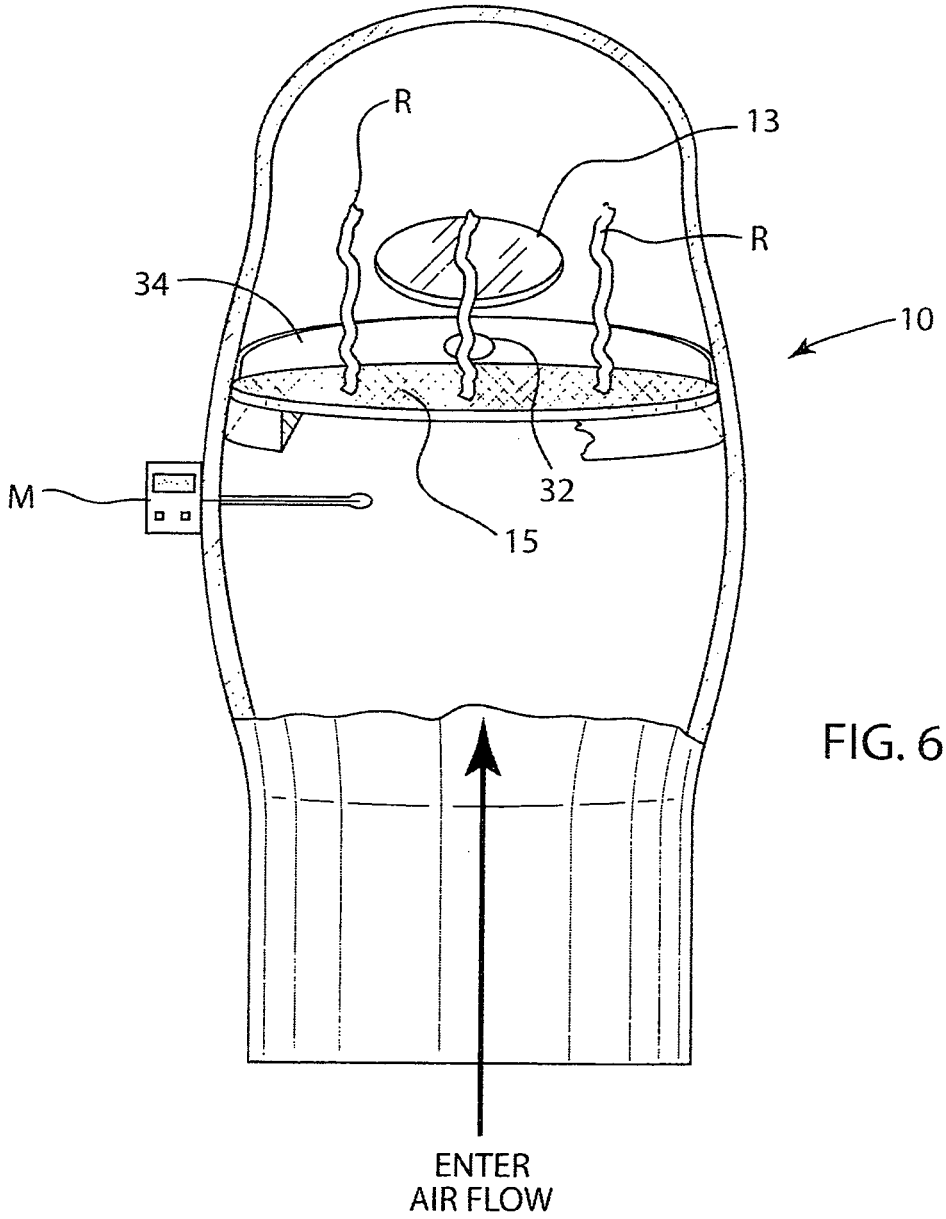
FIG. 6 shows cut away rear view of diagnostic bypass filter housing with mechanical and non-mechanical air flow indicators.

FIG. 6 shows rear cross sectional view of the diagnostic bypass filter housing 10 comprising an observation window 13 at front of the diagnostic bypass filter housing 10. The water gutter 34 is positioned within the diagnostic bypass filter housing 10 to receive water which is drained out of the diagnostic bypass filter housing 10 through the water drain spout 32. Ice and debris are retained by the filter 15.

Another embodiment is the mechanical air flow indicator "M" attached onto and within the diagnostic bypass filter housing 10 to measure air movement conditions as the air passes through the air flow corridor "C" of the diagnostic bypass filter housing 10. The mechanical air flow indicator "M" monitors the air flow velocity and volume.

At present I contemplate the use of a manometer but other devices are suitable. The measurement of air pressure, air flow and air velocity are necessary to monitor and evaluate the performance of a gaseous fluid mitigation system.

Figure 7:
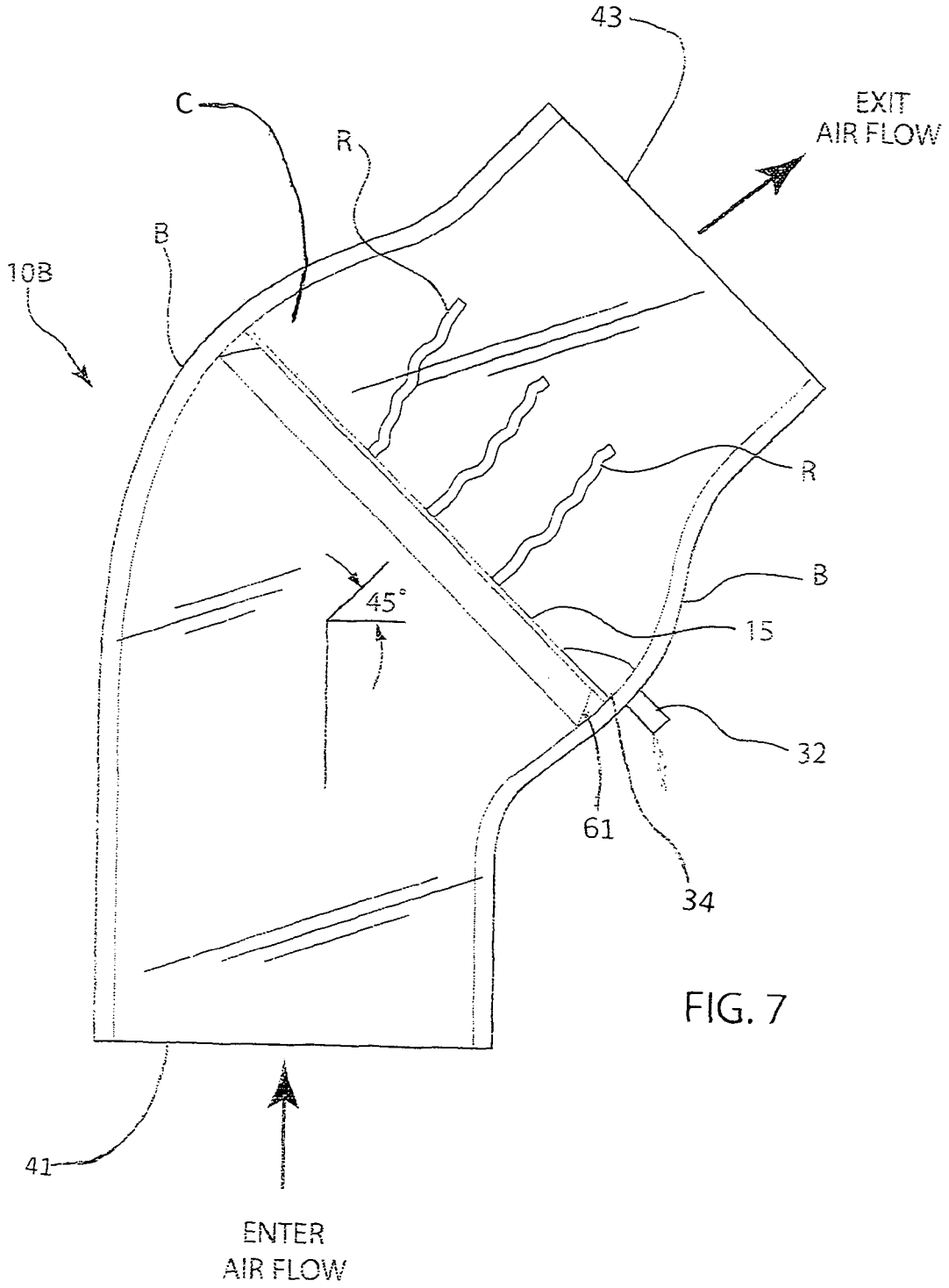
FIG. 7 shows side view of transparent diagnostic bypass filter housing at forty-five degrees bend with suction and exhaust ports.

FIG. 7 shows the side view of another embodiment, the transparent diagnostic bypass filter housing 10B. The transparent diagnostic bypass filter housing 10B is composed of a plastic formula to withstand direct sunlight conditions and allow solar light and solar heat to enter the transparent diagnostic bypass filter housing 10B.

The air flow corridor "C" is expanded through the bulge area "B" to allow additional air passage to compensate for assembly 30 obstructions. The transparent diagnostic bypass filter housing 10B will allow internal observation within the transparent diagnostic bypass filter housing 10B. At present I contemplate the use of transparent plastic, 1/16" to 5/16" thick, but other materials and thicknesses are suitable.

Another embodiment is the transparent diagnostic bypass filter housing 10B allows solar light for clearer observation and solar heat to penetrate the transparent diagnostic bypass filter housing 10B to assist the melting of fallen ice, which is resting on the filter 15. The bulge area "B" of the transparent diagnostic bypass filter housing 10B allows an expansion of the air flow corridor "C" for additional air passage to offset restrictions caused by the filter 15, gutter 34 and the non-mechanical air flow indicator "R".

Another embodiment is the circular shape of the suction port 41 and the circular shape of the exhaust port 43 to mate with radon fan 25 circular ports and circular openings of other standard plumbing pipe and plumbing system components.

Another embodiment is the forty-five degree angle of the circular suction port 41 in relationship to the circular exhaust port 43 of the transparent monitoring, diagnostic bypass filter housing 10B. The forty-five degree angle bend of the suction port 41 in relationship to the exhaust port 43 is compatible with angles of standard plumbing components.

The forty-five degree bend within the transparent diagnostic bypass filter housing 10B and diagnostic bypass filter housing 10 is an efficient angle for job site installations and standard plumbing connections. At present I contemplate a forty five degree angle, but other angles, particularly 90 degree angles are suitable. Water drains out of the transparent monitoring, diagnostic bypass filter housing 10B through the drain spout 32 by downward gravity.

FIG. 8 shows the filter 15, gutter 34 and drain spout 32 as one assembly unit 30 which is located within the bulge area "B" of the bypass housing 10. The assembly 30 is comprised of the filter 15, gutter 34 and drain spout 32. The filter 15 prevents ice or debris from entering the radon fan 25.

At present I contemplate the use of stainless steel metal screen mesh with 0.50" openings for the filter 15 but other materials and sizes are suitable.

The gutter 34, catches water and prevents it from entering the radon fan 25. The gutter 34 has a crescent-shaped gutter floor 34*a*. The gutter floor 34*a* outer edge matches the curvature outer edge of the filter 15 as it conforms to the roundness of the diagnostic bypass filter housing 10 wall. The rounded gutter wall 34*b* is right angled to the gutter floor 34*a* and completely connected to gutter floor 34*a* as one unit, which referenced as gutter 34.

Another embodiment is that the gutter floor 34*a* can be positioned below and constructed as part of the diagnostic bypass filter housing 10 and serve as support for the filter 15. The gutter 34 receives water and directs it through the water spout opening 32*a*, which is located in the center of the intersection of the gutter floor 34*a* and the gutter wall 34*b*.

At present I contemplate the use of plastic for the gutter but other materials are suitable.

The water spout 32 receives water from the gutter 34 through the water spout opening 32*a* and drains the water away from the diagnostic bypass filter housing 10. At present I contemplate the use of plastic for the water spout but other materials and sizes are suitable.

The air resistance created by placing the assembly 30 within the diagnostic bypass filter housing 10 is compensated for, by the added air space of the bulge area "B" which is described in more detail in FIG. 9.

FIG. 8.1 Another embodiment is the positioning of the gutter floor 34*a* directly atop the support 61 and under the ice filter 15*a*. Directly atop the gutter floor 34*a* the ice filter 15*a* is positioned. This embodiment allows the gutter floor 34*a* to support the filter 15*a*. The spout opening 32*a* is positioned on the same plane as the gutter floor 34*a* and the drain spout 32 connects to the gutter wall 32*a* at the spout opening 32*a*. The gutter wall 34*b* is 90 degrees angled to the gutter floor 34*a*.

In this embodiment, the gutter floor 34*a* becomes as one with the support 34*c*, FIG. 11 The lower point of the spout opening 32*a* and lower point of the drain spout 32 are at the same plane as the top of the gutter floor 34*a* to allow gravity induced water drainage out of the bypass housing 10.

At present I contemplate the use of plastic for the gutter and bypass housing but other materials are suitable.

FIG. 9 Another embodiment of the diagnostic bypass filter housing 10 is its multiple circumference sizes 40, of the suction port 41 and the multiple circumference sizes 42, of the exhaust port 43. The multiple sizes 40 of the suction port 41 and the multiple sizes 42 of the exhaust port 43 allow multiple sized connections to other mitigation system components. Air produced by the radon fan 25 enters the suction port 41 of the bypass housing 10 and continues through the air flow corridor "C" of the bypass housing 10 and exits through the exhaust port 43.

At present I contemplate the use of plastic with wall thickness of 1/16" to 5/16" for the diagnostic bypass filter housing 10, but other materials and thicknesses are suitable.

Another embodiment of the diagnostic bypass filter housing 10 is the female threaded access opening 11*b* on the rear side to allow inspections and servicing the interior of the diagnostic bypass filter housing 10. The closure cap 11*a*, mates with the access opening 11*b* for an air-tight seal when closed. Located within the closure cap 11*a* is the window 11, for monitoring activity within the diagnostic bypass filter housing 10. The window 11 additionally allows solar light and solar heat to enter into the diagnostic bypass filter housing 10 to assist interior monitoring.

Other embodiments are windows 12, located on each side of the diagnostic bypass filter housing 10 to monitor the non-mechanical air flow indicators "R" allowing solar light and solar heat within the bypass diagnostic bypass filter housing 10. Window 13, located on the front side of the diagnostic bypass filter housing 10 to monitor the non-mechanical air flow indicators "R" and allow solar light and solar heat within the bypass housing 10.

At present I contemplate the use of transparent plastic, 0.25" thick by 1" diameter for the observation windows 11,12,13, but other materials, sizes, shapes and thicknesses are suitable.

Another embodiment is the bulge area "B", which allows additional air passage to offset the air flow resistance caused by the assembly 30, within the diagnostic bypass filter housing 10. The air flow reduction caused by the assembly 30 is compensated for by the bulge area "B" within the diagnostic bypass filter housing 10. The bulge area "B" provides added space for air flow corridor "C" to allow additional air passage volume by the expanded circumference at the mid-section of the diagnostic bypass filter housing 10.

Another embodiment is the enlarged circumference of the filter 15, sized to fit firmly and completely within the enlarged air passage bulge area "B" of the diagnostic bypass filter housing 10 to provide added air passage. The larger surface area of the filter allows more air flow volume. The outer circumference of filter 15, mates with the interior circumference of the bulge area "B".

Another embodiment of the filter 15 is the secured position atop the built-in support 61, fitting tightly within the bulge area "B". Another embodiment of the filter 15 is the connection to the gutter 34, which is connected to the drain spout 32. The circular filter 15, gutter 34 and drain spout 32 combine to form the assembly 30. The assembly 30 is located within the bulge area "B" at its largest circumference to maximize air flow passage through the diagnostic bypass filter housing 10 and prevent damaging objects from entering the radon fan 25 while expelling water out of the diagnostic bypass filter housing 10 through the drain spout 32. The gutter 34 is sized and shaped to minimize air resistance while meeting the water containment requirements of the diagnostic bypass filter housing 10.

At present I contemplate the use of plastic 1/16" to 5/16" thick for the water gutter and water spout, but other materials and thicknesses are suitable.

FIG. 10 another embodiment is the ability to select any degree of a 360 degree rotation 44 to connect the bypass housing 10 directly to the radon fan 25 with the installation of coupling 25*c* and fastener 25*b*. Coupling 25*c* and fastener 25*b* are adjustable, removable and reusable.

A custom job site installation requires adjustments for satisfactory positioning prior to connecting the diagnostic bypass filter housing 10 to the radon fan 25 at a selected degree of a 360 degree rotation 44. Placement adjustments of radon fan 25 and diagnostic bypass filter housing 10 are standard procedure of an on-site radon mitigation installation.

The removable coupling 25*c* and removable fasteners 25*b* allows job site position adjustment of the bypass housing 10 in relationship to the radon fan 25 within the 360 degree rotation.

Another embodiment is that the direct connection of the bypass diagnostic bypass filter housing 10 to the radon fan 25 eliminates the need for the flexible coupling 24 of the mitigation system 200 and the mitigation system 202, resulting in the exhaust radon fan 25 and the bypass housing 10 being connected with fastener 25*b* and coupling 25*c* as a single unit 400.

Another embodiment of the coupling 25*c* and fastener 25*b* is the ability to adjust the diagnostic bypass filter housing 10 by rotation 44 in relationship to the radon fan 25 for installation at the job site to accommodate unique job site conditions.

Another embodiment is the connection of the diagnostic bypass filter housing 10 directly to the radon fan 25 at any degree of a 360 degree rotation 44 at a job site with the fastener 25*b* and coupling 25*c*, allowing the elimination of the flexible coupling 24. At present I contemplate the use of plastic for the coupling and fastener, but other materials are suitable.

FIG. 11 another embodiment is the permanent and non-removable adapter 46 which connects the diagnostic bypass filter housing 10 directly to the radon fan 25 at any degree of a 360 degree rotation 44 at the job site as required by unique job site installation conditions. The job site connection of the diagnostic bypass filter housing 10 to the radon fan 25 with the permanent and non-removable adapter 46 provides a means for a radon mitigation installation to conform to unique job site installation conditions as part of the complete installation of the typical radon mitigation system.

Another embodiment is the ability to adjust the position of the bypass diagnostic bypass filter housing 10 in relationship to the radon fan 25 as required, prior to the final "lock down" of the permanent and non-removable adapter 46. At present I contemplate the use of plastic for the adapter, but other materials are suitable.

Another embodiment is the direct connection of the diagnostic bypass filter housing 10 to the radon fan 25 with the adapter 46 allowing elimination of the need for a flexible coupling 24.

Another embodiment is the single unit 500, which is assembled at the job site, comprising the radon fan 25 permanently connected to the diagnostic bypass filter housing 10 by the non-removable coupling 46 to form this single unit 500.

Another embodiment is the gutter, ice filter support 34*c*, which is part of the diagnostic bypass filter housing 10. The gutter, ice filter support 34*c* being as one with the diagnostic bypass filter housing 10 as a single embodiment. The combination of the gutter, ice filter support 34*c* and the diagnostic bypass filter housing 10 allows the ice filter 15*a* to be located above the gutter, ice filter support 34*c*.

The interior front wall of diagnostic bypass filter housing 10 extends inward towards the center of the diagnostic bypass filter housing 10 and flairs out to become the gutter floor 34*c*. The inner front wall of the bypass housing tapers into the gutter floor 34*c*. The gutter floor 34*c* is identical to the ice filter support 34*c* which is an extension of the diagnostic bypass filter housing 10 front wall.

Operation

This embodiment composes a diagnostic bypass filter housing 10 and vent housing 23, being airtight with additional embodiments. The diagnostic bypass filter housing 10 is manufactured with plastic formulas The diagnostic bypass filter housing 10, FIGS. 1, 1A, 1C, 1D, 2, 2A, 3, 5, 6, 9, 10 and 11 is mostly hollow, with an angular bend and an elliptical bulge "B". A circular suction port 41 receives radon laced air and a circular exhaust port 43 expels the same radon laced air. Exhaust port 43 is at a forty-five to ninety degree angle to the suction port 41, with the 45 to 90 degree angle bend being at mid-point of the diagnostic bypass filter housing 10.

Placed within the bulge "B" of the diagnostic bypass filter housing 10 is the assembly 30, comprising ice filter 15, 15*a*, water gutter 34 and drain spout 32.

FIG. 8 shows the assembly 30 resting above the ice filter 15.

FIG. 8.1 shows the ice filter 15*a* resting on the gutter 34*a*.

FIG. 11 shows the gutter 34*c* being an extension of the diagnostic bypass filter housing 10 wall and supporting the ice filter 15*a*.

Another embodiment is the enlarged air passage bulge area "B" located within the midsection of the diagnostic bypass filter housing 10 and transparent diagnostic bypass filter housing 10*b* to accept air flow corridor "C". The bulge area "B" is an eccentric ellipse shaped expansion of the diagnostic bypass filter housing's 10,10*b* circumference to provide additional space for the expanded air flow corridor "C".

Radon fan 25 operates more efficiently and draws less amperage when there is less resistance. A radon fan 25 that is designed to operate at maximum efficiency when pushing air through a pipe of a specific size will work harder with additional stress if the pipe's size has been reduced.

The radon mitigation system 200 and 202 show the radon fan pulling radon laced air from the sub-soil "S" through the system and exhausting the radon laced air to the atmosphere through vent housing 23.

Attempts by others to divert condensate, trap ice, install birds and animals screens, or block rain water intrusion has created air blockages, resulting in strain on the radon fan 25. within the mitigation system 200.

The air resistance causes the radon fan to draw more amperage, work harder, consume more electricity and wear out sooner. Total air blockage from ice build-up will burn-up the radon fan motor, shutting down the system causing serious health issues from radon exposure.

The diagnostic bypass filter housing 10, contains a ice filter 15, sized to firmly fit within the bulge area "B" to catch objects such as ice or debris and prevents them from entering the radon fan 25. The gutter 34, having a crescent shape with the outer edge matching the circular shape of the ice filter 15, catches water and directs it out of the diagnostic bypass filter housing 10 through the drain spout 32.

At present I contemplate the Ice filter 15 is manufactured of rigid stainless steel screen with 0.50" openings and may be positioned above or below the gutter 34, but other materials, sizes and positions are suitable. At present I contemplate the gutter 34 is crescent shaped, with a thickness of between 1/16" to 5/16", made of plastic, with shape and size to catch water and minimize air resistance, but other materials, shapes and sizes are suitable.

The drain spout 32 is hollow and aligned with the gutter 34 to receive water from the gutter 34 at the hollow drain opening 32*a*, located at the lower center point of the gutter wall 34*b* and channel the water out of the diagnostic bypass filter housing 10 and away from the radon fan 25. The water drain 32 has a hollow channel that is sized between 1/16" and 1" diameter.

In FIG. 10, the diagnostic bypass filter housing 10 is connected directly to the radon fan 25 with removable fastener 25*b* and removable coupling 25*c*.

In FIG. 11, the diagnostic bypass filter housing 10 is connected directly to the radon fan 25 by non-removable connector 46.

The observation windows 11,12,13 of diagnostic bypass filter housing 10 are made of transparent plastic with diameters 1/4" to 3" and thickness 1/16" to 5/16" and are placed on all sides of bypass housing 10, including into the closure cap 11*a* for interior lighting and observation.

The access opening 11*b* on the rear side of the bypass housing 10 provides an entry into the diagnostic bypass filter housing 10 for inspections, maintenance and testing. During normal radon fan 25 operations, the access opening 11*b* is closed off with the closure cap 11*a*. The access opening 11*b* has female threads and is sized from 1/4" to 3" diameter.

The closure cap 11*a* sized from 1/4" to 3" diameter with male threads to match the female threads of the access opening 11*b* is made of plastic and includes a built-in bolt head suitable for wrenching on and off.

The bypass housing contains non-mechanical air flow indicators "R" to indicate air movement through the diagnostic bypass filter housing 10 to monitor the performance of the radon fan 25. The indicators "R" may be ribbons attached to the ice filter 15 or other suitable locations within the diagnostic bypass filter housing 10.

Conditions can be monitored without entering the diagnostic bypass filter housing 10 by viewing through one of the observation windows 11,12,13. More than one observation window allows sun light to enter the diagnostic bypass filter housing 10 from different sides, producing light for visual monitoring. Observation windows on all of the diagnostic bypass filter housing 10 sides permits the observer to monitor different side views of the diagnostic bypass filter housing 10 interior.

The mechanical air flow indicator "M", being electrically or battery powered provides a more detailed and exact performance evaluation of air pressure, volume, velocity, consistency and reliability within the bypass diagnostic bypass filter housing 10 and the mitigation system.

The indicator "M" with probes and sensors located within the bypass diagnostic bypass filter housing 10 to collect air flow information and is connected to display screens or computers located outside the bypass housing 10. Air movement monitoring equipment is known in the testing industry.

The transparent diagnostic bypass filter housing 10*b* contains all of the embodiments of the diagnostic bypass filter housing 10 except the need for observation windows. The total transparency provided by the transparent diagnostic bypass filter housing 10*b* allows internal monitoring without entering the transparent diagnostic bypass filter housing 10*b*. The transparent diagnostic bypass filter housing 10*b* is made from transparent plastic that is suitable for exterior conditions, including damage from direct sunlight. The housing 10*b* wall is 1/16" to 5/16" thick with the embodiments of the diagnostic bypass filter housing 10.

The vent housing 23, FIG. 1,1A,1B,1C,1D, is hollow cylindrical shaped, open at the lower enter port 23F to receive radon laced air from radon fan 25. The housings 23,23E are caped 23G at the top of the vent and may be opaque or transparent to allow solar heat within the housing 23,23E. The vent housing 23 is an opaque body and vent housing 23E is a transparent body to allow additional solar heat within the transparent housing 23E.

The 4" diameter vent housings 23, 23E contains approximately 87 exhaust openings 23C, which are sized at 4.25 inches horizontal by 5/16 inches vertical, resulting in 114 square inches of exhaust openings.

The formula: 87×4.25 inches×0.31 inches=114 square inches of exhaust opening 23C.

This 114 square inches of exhaust openings 23C represents 900% more opening area then a typical 4" diameter birds and animal screen 70, which is typically located at the top of a 4" radon exhaust pipe. The 4" birds and animal screen 70 has approximately 12.56 square inches of exhaust area.

At present I contemplate 3" to 14" diameter vents, but other diameters are suitable.

4" Diameter Vent housing 23, 23E=114 square inches of exhaust opening area.

4"Diameter Birds and Animals Screen 70=12.56 square inches of exhaust opening area.

At present I contemplate the vent housing wall 23, 23E and vent cap 23G are manufactured from plastic formulas with wall 23D thicknesses from 1/16" to 5/16", but other thicknesses are suitable.

The horizontal elongated exhaust openings 23C are angled vertically at approximately 45 degrees, with the inside of the opening 23C being higher than the outside of the opening 23C within the wall 23D to prevent rain water and unwanted objects from entering the vent housing 23 and 23E. The exhaust openings 23C with combined 114 square inches of open area reduces the risk of ice formation that can block air passage through the 12.56 square inch exhaust openings of the 4" birds and animal screen 70.

Additionally, because the exhaust openings 23C are located on the vertical wall 23D, there is less risk of falling snow or frozen rain blocking the openings 23C as compared to the horizontal openings of the birds and animals screen 70.

The metal wire used in the birds and animals screen 70 freezes-up faster than the plastic vent housing 23 due to the fact that metal conducts coldness faster than plastic and it has a smaller area for air passage.

In FIGS. 1C and 1D, the vent housing 23 and 23E is connected directly to diagnostic bypass filter housing 10 by connector 50 to meet custom job site requirements.

In FIGS. 1 and 1A, the vent housing 23 and 23A is connected indirectly by plumbing pipe 21 and elbow 20 to meet custom job site requirements.

CONCLUSION, RAMIFICATIONS AND SCOPE

Thus the reader will see that at least one embodiment of the gaseous fluid mitigation system protection apparatus provides a greater level of damage protection and monitoring for a radon mitigation system and can be installed by those in the radon mitigation installation trade.

Although the description above contains many specificities, these should not be construed as limiting the scope of the embodiments but as merely providing illustrations of some of the presently preferred embodiments. For example, the Bulge can have other sizes and shapes such as circular, oval or eccentric.

Thus the scope of the embodiments should be determined by the appended claims and their legal equivalents, rather than by the examples given.

I claim:

1. A diagnostic bypass filter apparatus in an exhaust system for blocking falling ice which forms inside said exhaust system, debris, birds and animals which enter from the discharge end of said exhaust system, for diverting water which forms inside said exhaust system, for permitting visual inspections and internal cleaning of said diagnostic bypass filter apparatus, for permitting access to the inside of said diagnostic bypass filter apparatus for air quality and air flow testing, said exhaust system comprising an exhaust side having a hollow interior and an inner surface, a flexible exhaust coupling, a diagnostic bypass filter apparatus, a hollow exhaust pipe elbow, a hollow exhaust pipe on which ice and condensate may be formed, a discharge end with a vent housing where debris, birds and animals may enter, a suction side having a hollow interior, and a fan apparatus interposed between said exhaust side and said suction side and coupled to each of said exhaust side and said suction side to form a conduit through which a gaseous fluid may be conveyed, wherein said gaseous fluid is drawn by said fan apparatus from said suction side and expelled by said fan apparatus through said exhaust side, said diagnostic bypass filter apparatus comprising:

a diagnostic bypass filter housing comprising a first open end and a second open end with a continuous hollow interior between said first open end and said second open end communicating between said first open end and said second open end having an elongated curved elbow configuration providing an angle between the said first open end and the said second open end a diagnostic bypass filter housing bulge area, the bulge area having a circular section with an expanded circumference at a midsection forming an eccentric ellipse shaped expansion of said diagnostic bypass filter housing, said first open end communicating with said exhaust side of said fan apparatus to said hollow interior thereof and said second open end communicating through said exhaust side to said hollow interior thereof in a manner maximizing air flow; and a filter, with an axis of said filter substantially coincident with an axis of said first open end of said diagnosis bypass filter housing and said enlarged center elliptical bulge of said diagnostic bypass filter housing, comprising a diameter being dimensioned to fit said hollow interior circumference of the center of the said enlarged elliptical bulge and angular bend section of said diagnostic bypass filter housing, being arranged in a manner forming a barrier comprising said inner surface of the of said diagnostic bypass filter housing and an outer edge of said screen positioned to block falling ice, debris, birds and animals which may form and/or enter said exhaust system; and a gutter supporting said filter comprising a crescent shape gutter floor constructed as part of said hollow interior of said diagnostic bypass filter housing extending half way around said hollow interior of said diagnostic bypass filter and located at a lower apex of said elliptical bulge, said gutter substantially coincident with the axis of said first open end of said diagnosis bypass filter housing and positioned to collect condensate and melted ice which may drain within said diagnostic bypass filter housing; and air flow indicators comprising flexible, light-weight ribbon type material attached at their bottoms to said filter on the exit air flow side of the filter with their upper portion being lifted upwardly by air flow produced below by said fan apparatus providing visual system performance evaluation without entering said diagnostic bypass filter housing; and a drain spout comprising a hollow interior having a first open end and a second open end, said hollow interior communicating between said first open end and said second open end, said first open end of said drain spout communicating through said diagnostic bypass filter housing to said hollow interior there of immediately adjacent to the lowest point of a conical surface of said gutter and within said gutter, said second open end communicating with the outside of the said diagnostic bypass filter housing; and a removable observation window located in said diagnostic bypass filter housing between said filter and said first open end of said diagnostic bypass filter at an upper apex of said elliptical bulge comprising an access opening having a hollow female threaded interior having a first open and a second open end, said hollow female threaded interior communicating between said first open end and second open end, said first open end communicating with the outside of said diagnostic bypass filter housing and said second open end communicating with the interior of said elliptical bulge, and having a see through closure cap with male threads to match said access opening hollow female threaded interior having a bolt head configuration built in suitable for wrenching said closure cap on and off providing for the inspection and servicing of the interior of the diagnostic bypass filter, and sealing said access opening, and three observation windows located in said diagnostic bypass filter housing between said filter and said first open end of said diagnostic bypass filter housing, having two of said observation windows diametric to each other on the sides of said diagnostic bypass housing and the third said observation window diametric to said removable observation window providing the capability for visual inspection of said interior of the diagnostic bypass filter housing while said exhaust system is operating.

2. The diagnostic bypass filter apparatus of claim 1, wherein said exhaust system is a radon mitigation system.

3. The diagnostic bypass filter apparatus of claim 1, wherein said angle between the said first open end and the said second open end is forty-five degrees.

4. An-exhaust system for removing a gaseous fluid containing radon comprising:

an exhaust fan apparatus comprising a housing having an exhaust port and a suction port and enclosing a fan, wherein the operation of said fan draws a gaseous fluid into said suction port and expels said gaseous fluid from said exhaust port;

a cylindrical suction conduit comprising a hollow interior, a first open end, and at least one other open end, said hollow interior communicating between first open end each of said at least one other open ends, said suction pipe being otherwise substantially air tight, wherein said first open end is substantially air tightly coupled with said suction port and each of said at least one other open ends is located proximate to said gaseous fluid so that said gaseous fluid is conducted by operation of said fan from each of said at least one other open ends of said suction conduit through said suction conduit to said suction port;

a cylindrical exhaust conduit comprising a hollow interior, a first open end, at least one other open end, and an inner surface, said hollow interior communicating between said first open end and each one of said at least one other open ends, said exhaust pipe being otherwise substantially airtight, wherein said first open end is substantially air tightly coupled to said exhaust port each of said at least one other open ends is located at a predetermined level above ground so that said gaseous fluid is conducted by operation of said fan from said exhaust port through said exhaust conduit to each of said at least one other open ends of said exhaust conduit;

a diagnostic bypass filter housing comprising a first open end and a second open end with a continuous hollow interior between said first open end and said second open end communicating between said first open end and said second open end having an elongated curved elbow configuration providing an angle between the said first open end and the said second open end of a diagnostic bypass filter housing bulge area, the bulge area having a circular section with an expanded circumference at a midsection forming an eccentric ellipse shaped expansion of said diagnostic bypass filter housing, said first open end communicating with said exhaust side of said fan apparatus to said hollow interior thereof and said second open end communicating through said exhaust side to said hollow interior thereof in a manner maximizing air flow; and a filter, with an axis of said filter substantially coincident with an axis of said first open end of said diagnosis bypass filter housing and said enlarged center elliptical bulge of said diagnostic bypass filter housing, comprising a diameter being dimensioned to fit said hollow interior circumference of the center of the said enlarged elliptical bulge and angular bend section of said diagnostic bypass filter housing, being arranged in a manner forming a barrier comprising said inner surface of the of said diagnostic bypass filter housing and an outer edge of said screen positioned to block falling ice, debris, birds and animals which form and or enter said exhaust system; and a gutter supporting said filter comprising a crescent shape gutter floor constructed as part of said hollow interior of said diagnostic bypass filter housing extending half way around said hollow interior of said diagnostic bypass filter and located at a lower apex of said elliptical bulge, said gutter substantially coincident with the axis of said first open end of said diagnosis bypass filter housing and positioned to collect water and melted ice which form within said diagnostic bypass filter housing; and air flow indicators comprising flexible, light-weight ribbon type material attached at their bottoms to said filter on the exit air flow side of the filter with their upper portion being lifted upwardly by air flow produced below by said fan apparatus providing visual system performance evaluation without entering said diagnostic bypass filter housing; and a drain spout comprising a hollow interior having a first open end and a second open end, said hollow interior communicating between said first open end and said second open end, said first open end of said drain spout communicating through said diagnostic bypass filter housing to said hollow interior there of immediately adjacent to the lowest point of a conical surface of said gutter and within said gutter, said second open end communicating with the outside of the said diagnostic bypass filter housing to discharge said water and melted ice; and a removable observation window located in said diagnostic bypass filter housing between said filter and said first open end of said diagnostic bypass filter at an upper apex of said elliptical bulge comprising an access opening having a hollow female threaded interior having a first open and a second open end, said hollow female threaded interior communicating between said first open end and second open end, said first open end communicating with the outside of said diagnostic bypass filter housing and said second open end communicating with the interior of said elliptical bulge, and having a see through closure cap with male threads to match said access opening hollow female threaded interior having a bolt head configuration built in suitable for wrenching said closure cap on and off providing for the inspection and servicing of the interior of the diagnostic bypass filter and sealing said access opening, and three observation windows located in said diagnostic bypass filter housing between said filter and said first open end of said diagnostic bypass filter housing, having two of said observation windows diametric to each other on the sides of said diagnostic bypass housing and the third said observation window diametric to said removable observation window providing the capability for visual inspection of said interior of the diagnostic bypass filter housing while said radon mitigation system is operating; and a vent housing comprising a first open end and a second open end and a continuous hollow interior between said first open end and said second open end communicating between said first open end and said second open end having a hollow cylindrical shape with multiple horizontal elongated exhaust openings symmetrically running along and aligned at right angle to the latitudinal axis of said hollow cylindrical shape that are angled vertically with the interior side of said elongated exhaust openings being higher than the exterior of said elongated exhaust openings within the wall of said vent housing which prevent rain water and objects from entering said vent housing, said first open end of said vent housing is coupled to exit air flow end of said cylindrical exhaust conduit and second open end of said vent housing is sealed with a cap.

5. The vent housing of claim 4, wherein said horizontal elongated exhaust openings are sized at 4¼ inches horizontally by 5/16 inches vertically and are approximately 87 in number providing decreased air flow resistance which increases the efficiency of the exhaust system.

6. The vent housing of claim 4, wherein the said vent housing is manufactured with opaque or transparent materials providing for solar heat within said vent housing to prevent ice build up and subsequent air-flow reduction.

7. The diagnostic bypass filter apparatus of claim 4, wherein said angle between the said first open end and the said second open end is forty-five degrees.

* * * * *